US007567228B1

(12) United States Patent
Wen et al.

(10) Patent No.: US 7,567,228 B1
(45) Date of Patent: Jul. 28, 2009

(54) MULTI SWITCH PIXEL DESIGN USING COLUMN INVERSION DATA DRIVING

(75) Inventors: Yi-Chien Wen, Hsinchu (TW); Chao-Liang Lu, Hsinchu (TW); Ken-Ming Chen, Hsinchu (TW); Chi-Mao Hung, Hsinchu (TW); Chun-Huai Li, Hsinchu (TW); Jing-Tin Kuo, Hsinchu (TW); Chang-Wei Su, Hsinchu (TW); Yao-Jen Hsieh, Hsinchu (TW)

(73) Assignee: AU Optronics Corporation, Hsinchu (TW)

( * ) Notice: Subject to any disclaimer, the term of this patent is extended or adjusted under 35 U.S.C. 154(b) by 0 days.

(21) Appl. No.: 12/204,443

(22) Filed: Sep. 4, 2008

(51) Int. Cl.
*G09G 3/36* (2006.01)

(52) U.S. Cl. ..... 345/87; 345/89; 345/96; 345/204; 345/209; 345/211

(58) Field of Classification Search ..... 345/87–104, 345/204–215, 690–699
See application file for complete search history.

(56) References Cited

U.S. PATENT DOCUMENTS 7,061,478 B1 * 6/2006 Moyer ..... 345/204
7,260,494 B2 * 8/2007 Weiss ..... 702/120
7,289,095 B2 * 10/2007 Park et al. ..... 345/98

* cited by examiner

*Primary Examiner*—Vijay Shankar
(74) *Attorney, Agent, or Firm*—Morris Manning Martin LLP; Tim Tingkang Xia, Esq.

(57) ABSTRACT

A liquid crystal display (LCD) panel with power consumption reduction and methods of driving same. In one embodiment, the LCD panel includes a pixel matrix, a plurality of scanning lines and a plurality of data lines. Each pair of two neighboring scanning lines defines a pixel row therebetween, and each pair of two neighboring data lines defines a pixel column therebetween. Each pixel has at least a first sub-pixel and a second sub-pixel. Each sub-pixel has a sub-pixel electrode and a switching element electrically coupled to the sub-pixel electrode. Each pair of two neighboring scanning lines is electrically coupled to the switching elements of the first sub-pixel and the second sub-pixel of each pixel in the pixel row, respectively. Each data line is electrically coupled to the switching element of the first sub-pixel or the second sub-pixel of each odd pixel of one of two neighboring pixel columns associated with the data line and to the switching element of the second sub-pixel or the first sub-pixel of each even pixel of the other of the two neighboring pixel columns. The LCD panel further includes a gate driver and a data driver for generating scanning signals and data signals applied to the plurality of scanning lines and the plurality of data lines, respectively. The scanning signals are configured to turn on the switching elements connected to the plurality of scanning lines in a predefined sequence, and the data signals are configured such that any two neighboring data signals have inverted polarities.

41 Claims, 16 Drawing Sheets

200

300

MULTI SWITCH PIXEL DESIGN USING COLUMN INVERSION DATA DRIVING

FIELD OF THE INVENTION

The present invention relates generally to a liquid crystal display (LCD), and more particularly, to an LCD panel that utilizes a column inversion data driving scheme to reduce power consumption and methods of driving same.

BACKGROUND OF THE INVENTION

A liquid crystal display (LCD) device includes an LCD panel formed with liquid crystal cells and pixel elements with each associating with a corresponding liquid crystal cell and having a liquid crystal (LC) capacitor and a storage capacitor, a thin film transistor (TFT) electrically coupled with the liquid crystal capacitor and the storage capacitor. These pixel elements are substantially arranged in the form of a matrix having a number of pixel rows and a number of pixel columns. Typically, scanning signals are sequentially applied to the number of pixel rows for sequentially turning on the pixel elements row-by-row. When a scanning signal is applied to a pixel row to turn on corresponding TFTs of the pixel elements of a pixel row, source signals (i.e., image signals) for the pixel row are simultaneously applied to the number of pixel columns so as to charge the corresponding liquid crystal capacitor and storage capacitor of the pixel row for aligning orientations of the corresponding liquid crystal cells associated with the pixel row to control light transmittance therethrough. By repeating the procedure for all pixel rows, all pixel elements are supplied with corresponding source signals of the image signal, thereby displaying the image signal thereon.

Liquid crystal molecules have a definite orientational alignment as a result of their long, thin shapes. The orientations of liquid crystal molecules in liquid crystal cells of an LCD panel play a crucial role in the transmittance of light therethrough. It is known if a substantially high voltage potential is applied between the liquid crystal layer for a long period of time, the optical transmission characteristics of the liquid crystal molecules may change. This change may be permanent, causing an irreversible degradation in the display quality of the LCD panel. In order to prevent the LC molecules from being deteriorated, an LCD device is usually driven by using techniques that alternate the polarity of the voltages applied across a LC cell. These techniques may include inversion schemes such as frame inversion, row inversion, column inversion, and dot inversion. Typically, notwithstanding the inversion schemes, a higher image quality requires higher power consumption because of frequent polarity conversions. Such LCD devices, in particular thin film transistor (TFT) LCD devices, may consume significant amounts of power, which may in turn generate excessive heat. The characteristics of the LCD devices will be significantly deteriorated due to the heat generated.

Therefore, a heretofore unaddressed need exists in the art to address the aforementioned deficiencies and inadequacies.

SUMMARY OF THE INVENTION

The present invention, in one aspect, relates to an LCD panel with color washout improvement. In one embodiment, the LCD panel includes a common electrode; a plurality of scanning lines, $\{G_n\}$, n=1, 2, . . . , N, N being an integer greater than zero, spatially arranged along a row direction; a plurality of data lines, $\{D_m\}$, m=1, 2, . . . , M, M being an integer greater than zero, spatially arranged crossing the plurality of scanning lines $\{G_n\}$ along a column direction perpendicular to the row direction; and a plurality of pixels, $\{P_{n,m}\}$, spatially arranged in the form of a matrix, each pixel $P_{n,m}$ defined between two neighboring scanning lines $G_n$ and $G_n$, and two neighboring data lines $D_m$ and $D_{m+1}$. Each pixel $P_{n,m}$ comprises at least a first sub-pixel, $P_{n,m}$(1), and a second sub-pixel, $P_{n,m}$(2). Each of the first sub-pixel and the second sub-pixel includes a sub-pixel electrode, a liquid crystal (LC) capacitor electrically coupled between the sub-pixel electrode and the common electrode in parallel, and a transistor having a gate, a source and a drain electrically coupled to the sub-pixel electrode.

The gate and the source of the transistor of the first sub-pixel $P_{n,m}$(1) of the pixel $P_{n,m}$ are electrically coupled to the scanning line $G_n$, and the data line $D_m$, respectively, and the gate and the source of the transistor of the second sub-pixel $P_{n,m}$(2) of the pixel $P_{n,m}$ are electrically coupled to the scanning line $G_n$ and the sub-pixel electrode of the first sub-pixel $P_{n,m}$(1), respectively.

The gate and the source of the transistor of the first sub-pixel $P_{n+1,m}$(1) of the pixel $P_{n+1,m}$ are electrically coupled to the scanning line $G_{n+1}$ and the sub-pixel electrode 115*b* of the second sub-pixel $P_{n+1,m}$(2), respectively, and the gate and the source 116*s* of the transistor of the second sub-pixel $P_{n+1,m}$(2) of the pixel $P_{n+1,m}$ are electrically coupled to the scanning line $G_{n+2}$ and the data line $D_{m+1}$, respectively.

In one embodiment, each of the first sub-pixel $P_{n,m}$(1) and the second sub-pixel $P_{n,m}$(2) of the pixel $P_{n,m}$ further comprises a storage capacitor electrically coupled between the sub-pixel electrode and the common electrode in parallel.

Additionally, the LCD panel may have a plurality of touch sensing signal lines $\{L_k\}$, k=1, 2, . . . , K, K being an integer greater than zero. Each touch sensing signal line is arranged adjacent and parallel to a scanning line $G_n$ or a data line $D_m$. In one embodiment, each pixel in the even number pixel rows of the pixel matrix or each pixel in the odd number pixel rows of the pixel matrix further comprises a photo sensor (PS) and a transistor having a gate electrically connected to one of two corresponding scanning lines defining the pixel, a source electrically connected the photo sensor and a drain electrically connected to a corresponding touch sensing signal line.

The LCD panel also has a gate driver and a data driver. The gate driver is adapted for generating a plurality of scanning signals respectively applied to the plurality of scanning lines $\{G_n\}$, where the plurality of scanning signals is configured to turn on the transistors connected to the plurality of scanning lines $\{G_n\}$ in a predefined sequence. The data driver is adapted for generating a plurality of data signals respectively applied to the plurality of data lines $\{D_m\}$, where the plurality of data signals is configured such that any two neighboring data signals have inverted polarities.

In one embodiment, each of the plurality of scanning signals is configured to have a waveform. The waveform has a first voltage potential $V_1$ in a first duration, $T_1$, a second voltage potential $V_2$ in a second duration, $T_2$, a third voltage potential $V_3$ in a third duration, $T_3$, a fourth voltage potential $V_4$ in a fourth duration, $T_4$, and a fifth voltage potential $V_5$ in a fifth duration, $T_5$, where the (+1)-th duration $T_{j+1}$ is immediately after the j-th duration $T_j$, j=1, 2, 3 and 4, and $V_1=V_3=V_5>V_2=V_4$, $T_2=(T_1+2t)$, $T_3=(T_1-t)$, $T_4=2t$, $T_5=T_1$, and $T_1>>t$. The waveform of each of the scanning signals is sequentially shifted from one another by a duration of $T_1+T_2$.

In another embodiment, each of the plurality of scanning signals is configured to have a waveform, where the waveform of each of the plurality of scanning signals has a first voltage potential $V_1(t)$ in a first duration, $T_1$, a second voltage potential $V_2(t)$ in a second duration, $T_2$, and a third voltage potential $V_3(t)$ in a third duration, $T_3$. The second duration $T_2$ is immediately after the first duration $T_1$ and the third duration $T_3$ is immediately after the second duration $T_2$. $V_1(t)$ and $V_3(t)$ vary with time and $V_2(t)=V_2$ is a constant and independent of time. The first duration $T_1$ includes a first time period, $T_0$, and a second time period, $T=(T_1-T_0)$, immediately after the first time period $T_0$, where in the first time period $T_0$, $V_1(t)=V1$, a constant voltage potential, and $V_1(t)$ continuously decreases from $V_1$ to $V_0$ as time goes in the second time period T. The third duration $T_3$ includes a first time period, $T_0$, a second time period, T, immediately after the first time period $T_0$, and a third time period $(T_3-T_1-T_0)$, immediately after the second time period T, where $V_3(t)=V_3$, a constant voltage potential, in the first time period $T_0$, $V_3(t)$ continuously decreases from $V_3$ to $V_0$ as time goes in the second time period T, and $V_3(t)=V_3$ in the third time period, and where $V_1=V_3>V_2$, $V_1>V_0\geqq V_2$, $T_1=T_2$, and $T_3=2T_1$. The waveform of each of the scanning signals is sequentially shifted from one another by a duration of $T_1+T_2$.

In such a driving scheme, in operation, the plurality of pixels $\{P_{n,m}\}$ has a pixel polarity that is in a dot inversion.

In one embodiment, each of the transistors is a field-effect thin film transistor (TFT).

In another aspect, the present invention relates to a method of driving a liquid crystal display (LCD). In one embodiment, the method includes the steps of providing an LCD panel. The LCD panel has a common electrode, a plurality of scanning lines, $\{G_n\}$, n=1, 2, . . . , N, N being an integer greater than zero, spatially arranged along a row direction, a plurality of data lines, $\{D_m\}$, m=1, 2, . . . , M, M being an integer greater than zero, spatially arranged crossing the plurality of scanning lines $\{G_n\}$ along a column direction perpendicular to the row direction, and a plurality of pixels, $\{P_{n,m}\}$, spatially arranged in the form of a matrix.

Each pixel $P_{n,m}$ is defined between two neighboring scanning lines $G_n$ and $G_{n+1}$ and two neighboring data lines $D_m$ and $D_{m+1}$, and has at least a first sub-pixel, $P_{n,m}(\mathbf{1})$, and a second sub-pixel, $P_{n,m}(\mathbf{2})$. Each of the first sub-pixel and the second sub-pixel comprises a sub-pixel electrode, a liquid crystal (LC) capacitor electrically coupled between the sub-pixel electrode and the common electrode in parallel, and a transistor having a gate, a source and a drain electrically coupled to the sub-pixel electrode. The gate and the source of the transistor of the first sub-pixel $P_{n,m}(\mathbf{1})$ of the pixel $P_{n,m}$ are electrically coupled to the scanning line $G_{n+1}$ and the data line $D_m$, respectively. The gate and the source of the transistor of the second sub-pixel $P_{n,m}(\mathbf{2})$ of the pixel $P_{n,m}$ are electrically coupled to the scanning line $G_n$ and the sub-pixel electrode of the first sub-pixel $P_{n,m}(\mathbf{1})$, respectively. The gate and the source of the transistor of the first sub-pixel $P_{n+1,m}(\mathbf{1})$ of the pixel $P_{n+1,m}$ are electrically coupled to the scanning line $G_{n+1}$ and the sub-pixel electrode of the second sub-pixel $P_{n+1,m}(\mathbf{2})$, respectively. The gate and the source of the transistor of the second sub-pixel $P_{n+1,m}(\mathbf{2})$ of the pixel $P_{n+1,m}$ are electrically coupled to the scanning line $G_{n+2}$ and the data line $D_{mm+1}$, respectively.

Additionally, the LCD panel may have a plurality of touch sensing signal lines $\{L_k\}$, k=1, 2, . . . , K, K being an integer greater than zero. Each touch sensing signal line is arranged adjacent and parallel to a scanning line $G_n$ or a data line $D_m$. In one embodiment, each pixel in the even number pixel rows of the pixel matrix or each pixel in the odd number pixel rows of the pixel matrix further comprises a photo sensor (PS) and a transistor having a gate electrically connected to one of two corresponding scanning lines defining the pixel, a source electrically connected the photo sensor and a drain electrically connected to a corresponding touch sensing signal line.

The method further includes the step of applying a plurality of scanning signals to the plurality of scanning lines $\{G_n\}$ and a plurality of data signals to the plurality of data lines $\{D_m\}$, respectively. The plurality of scanning signals is configured to turn on the transistors connected to the plurality of scanning lines $\{G_n\}$ in a predefined sequence, and the plurality of data signals is configured such that any two neighboring data signals have inverted polarities. Accordingly, the plurality of pixels $\{P_{n,m}\}$ in operation has a pixel polarity that is in a dot inversion.

In yet another aspect, the present invention relates to a liquid crystal display (LCD) panel. In one embodiment, the LCD panel has a plurality of pixels, $\{P_{n,m}\}$, spatially arranged in the form of a matrix, n=1, 2, . . . , N, and m=1, 2, . . . , M, and N, M being an integer greater than zero. Each pixel $P_{n,m}$ has at least a first sub-pixel, $P_{n,m}(\mathbf{1})$ and a second sub-pixel, $P_{n,m}(\mathbf{2})$, where each of the first sub-pixel $P_{n,m}(\mathbf{1})$ and the second sub-pixel $P_{n,m}(\mathbf{2})$ comprises a sub-pixel electrode and a switching element electrically coupled to the sub-pixel electrode.

The LCD panel also has a plurality of scanning lines, $\{G_n\}$, spatially arranged along a row direction. Each pair of two neighboring scanning lines $G_n$ and $G_{n+1}$ defines a pixel row $P_{n,\{m\}}$ of the pixel matrix $\{P_{n,m}\}$ therebetween and is electrically coupled to the switching elements of the first sub-pixel and the second sub-pixel of each pixel in the pixel row $P_{n,\{m\}}$, respectively.

The LCD panel further has a plurality of data lines, $\{D_m\}$, spatially arranged crossing the plurality of scanning lines $\{G_n\}$ along a column direction perpendicular to the row direction. Each pair of two neighboring data lines $D_m$ and $D_{m+1}$ defines a pixel column, P{n},m, of the pixel matrix $\{P_{n,m}\}$ therebetween. Each data line $D_m$ is electrically coupled to the switching element of the first sub-pixel or the second sub-pixel of each odd pixel of one of two neighboring pixel columns $P_{\{n\},m-1}$ and $P_{\{n\},m}$ associated with the data line $D_m$ and to the switching element of the second sub-pixel or the first sub-pixel of each even pixel of the other of the two neighboring pixel columns $P_{\{n\},m-1}$ and $P_{\{n\},m}$.

Additionally, the LCD panel may also have at least one common electrode. In one embodiment, each of the first sub-pixel $P_{n,m}(\mathbf{1})$ and the second sub-pixel $P_{n,m}(\mathbf{2})$ of the pixel $P_{n,m}$ of the pixel matrix $\{P_{n,m}\}$ further comprises an LC capacitor and a storage capacitor both electrically coupled between the sub-pixel electrode and the common electrode in parallel.

Furthermore, the LCD panel has a gate driver for generating a plurality of scanning signals respectively applied to the plurality of scanning lines $\{G_n\}$, where the plurality of scanning signals is configured to turn on the switching elements connected to the plurality of scanning lines $\{G_n\}$ in a predefined sequence; and a data driver for generating a plurality of data signals respectively applied to the plurality of data lines $\{D_m\}$, where the plurality of data signals is configured such that any two neighboring data signals have inverted polarities. In operation, the plurality of pixels $\{P_{n,m}\}$ has a pixel polarity that is in a dot inversion.

In one embodiment, each of the switching elements of the first sub-pixel $P_{n,m}(\mathbf{1})$ and the second sub-pixel $P_{n,m}(\mathbf{1})$ of the pixel $P_{n,m}$ of the pixel matrix $\{P_{n,m}\}$ is a field-effect thin film transistor having a gate, a source and a drain. In one embodiment, the drain of the transistor of each of the first sub-pixel $P_{n,m}(\mathbf{1})$ and the second sub-pixel $P_{n,m}(\mathbf{2})$ of the pixel $P_{n,m}$ of the pixel matrix $\{P_{n,m}\}$ is electrically coupled to the sub-pixel electrode of the corresponding sub-pixel. The gate and the source of the transistor of the first sub-pixel $P_{n,m}(\mathbf{1})$ of the pixel $P_{n,m}$ of the pixel matrix $\{P_{n,m}\}$ are electrically coupled to the scanning line $G_{n+1}$ and the data line $D_m$, respectively. The gate and the source of the transistor of the second sub-pixel $P_{n,m}(2)$ of the pixel $P_{n,m}$ of the pixel matrix $\{P_{n,m}\}$ are electrically coupled to the scanning line $G_n$ and the sub-pixel electrode of the first sub-pixel $P_{n,m}(1)$, respectively. The gate and the source of the transistor of the first sub-pixel $P_{n+1,m}(1)$ of the pixel $P_{n+1,m}$ of the pixel matrix $\{P_{n,m}\}$ are electrically coupled to the scanning line $G_{n+}$ and the sub-pixel electrode of the second sub-pixel $P_{n+1,m}(2)$, respectively. The gate and the source of the transistor of the second sub-pixel $P_{n+1,m}(2)$ of the pixel $P_{n+1,m}$ of the pixel matrix $\{P_{n,m}\}$ are electrically coupled to the scanning line $G_{n+2}$ and the data line $D_{m+1}$, respectively.

Additionally, the LCD panel may have a plurality of touch sensing signal lines $\{L_k\}$, k=1, 2, . . . , K, K being an integer greater than zero. Each touch sensing signal line is arranged adjacent and parallel to a scanning line $G_n$ or a data line $D_m$. In one embodiment, each pixel in the even number pixel rows of the pixel matrix or each pixel in the odd number pixel rows of the pixel matrix further comprises a photo sensor (PS) and a transistor having a gate electrically connected to one of two corresponding scanning lines defining the pixel, a source electrically connected the photo sensor and a drain electrically connected to a corresponding touch sensing signal line.

In a further aspect, the present invention relates to a method of driving an LCD. In one embodiment, the method includes the steps of providing an LCD panel. The LCD panel in one embodiment, has a plurality of pixels, $\{P_{n,m}\}$, spatially arranged in the form of a matrix, n=1, 2, . . . , N, and m=1, 2, . . . , M, and N, M being an integer greater than zero. Each pixel $P_{n,m}$ has at least a first sub-pixel, $P_{n,m}(1)$ and a second sub-pixel, $P_{n,m}(2)$. Each of the first sub-pixel $P_{n,m}(1)$ and the second sub-pixel $P_{n,m}(2)$ comprises a sub-pixel electrode and a switching element electrically coupled to the sub-pixel electrode.

The LCD panel also has a plurality of scanning lines, $\{G_n\}$, spatially arranged along a row direction, and a plurality of data lines, $\{D_m\}$, spatially arranged crossing the plurality of scanning lines $\{G_n\}$ along a column direction perpendicular to the row direction. Each pair of two neighboring scanning lines $G_n$ and $G_{n-1}$ defines a pixel row $P_{n,\{m\}}$ of the pixel matrix $\{P_{n,m}\}$ therebetween and is electrically coupled to the switching elements of the first sub-pixel and the second sub-pixel of each pixel in the pixel row $P_{n,\{m\}}$, respectively. Each pair of two neighboring data lines $D_m$ and $D_{m+1}$ defines a pixel column, $P_{\{n\},m}$, of the pixel matrix $\{P_{n,m}\}$ therebetween. Each data line $D_m$ is electrically coupled to the switching element of the first sub-pixel or the second sub-pixel of each odd pixel of one of two neighboring pixel columns $P_{\{n\},m-1}$ and $P_{\{n\}}$ m associated with the data line $D_m$ and to the switching element of the second sub-pixel or the first sub-pixel of each even pixel of the other of the two neighboring pixel columns $P_{\{n\},m-1}$ and $P_{\{n\},m}$.

In one embodiment, the LCD panel further comprises at least one common electrode. Each of the first sub-pixel $P_{n,m}(1)$ and the second sub-pixel $P_{n,m}(2)$ of the pixel $P_{n,m}$ of the pixel matrix $\{P_{n,m}\}$ further comprises an LC capacitor and a storage capacitor both electrically coupled between the sub-pixel electrode and the common electrode in parallel.

In one embodiment, each of the switching elements of the first sub-pixel $P_{n,m}(1)$ and the second sub-pixel $P_{n,m}(1)$ of the pixel $P_{n,m}$ of the pixel matrix $\{P_{n,m}\}$ is a field-effect thin film transistor having a gate, a source and a drain. The drain of the transistor of each of the first sub-pixel $P_{n,m}(1)$ and the second sub-pixel $P_{n,m}(2)$ of each pixel $P_{n,m}$ of the pixel matrix $\{P_{n,m}\}$ is electrically coupled to the sub-pixel electrode of the corresponding sub-pixel. The gate and the source of the transistor of the first sub-pixel $P_{n,m}(1)$ of the pixel $P_{n,m}$ of the pixel matrix $\{P_{n,m}\}$ are electrically coupled to the scanning line $G_{n+1}$ and the data line $D_m$, respectively. The gate and the source of the transistor of the second sub-pixel $P_{n,m}(2)$ of the pixel $P_{n,m}$ of the pixel matrix $\{P_{n,m}\}$ are electrically coupled to the scanning line $G_n$ and the sub-pixel electrode of the first sub-pixel $P_{n,m}(1)$, respectively. The gate and the source of the transistor of the first sub-pixel $P_{n+1,m}(1)$ of the pixel $P_{n+1,m}$ of the pixel matrix $\{P_{n,m}\}$ are electrically coupled to the scanning line $G_{n+1}$ and the sub-pixel electrode of the second sub-pixel $P_{n+1,m}(2)$, respectively. The gate and the source of the transistor of the second sub-pixel $P_{n+1,m}(2)$ of the pixel $P_{n+1,m}$ of the pixel matrix $\{P_{n,m}\}$ are electrically coupled to the scanning line $G_{n+2}$ and the data line $D_{m+1}$, respectively.

Additionally, the LCD panel may have a plurality of touch sensing signal lines $\{L_k\}$, k=1, 2, . . . , K, K being an integer greater than zero. Each touch sensing signal line is arranged adjacent and parallel to a scanning line $G_n$ or a data line $D_m$. In one embodiment, each pixel in the even number pixel rows of the pixel matrix or each pixel in the odd number pixel rows of the pixel matrix further comprises a photo sensor (PS) and a transistor having a gate electrically connected to one of two corresponding scanning lines defining the pixel, a source electrically connected the photo sensor and a drain electrically connected to a corresponding touch sensing signal line.

Furthermore, the method includes the step of applying a plurality of scanning signals to the plurality of scanning lines $\{G_n\}$ and a plurality of data signals to the plurality of data lines $\{D_m\}$, respectively. The plurality of scanning signals is configured to turn on the switching elements connected to the plurality of scanning lines $\{G_n\}$ in a predefined sequence, and the plurality of data signals is configured such that any two neighboring data signals have inverted polarities. Accordingly, the plurality of pixels $\{P_{n,m}\}$ in operation has a pixel polarity that is in a dot inversion.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, wherein.

DETAILED DESCRIPTION OF THE INVENTION

Figure 1:
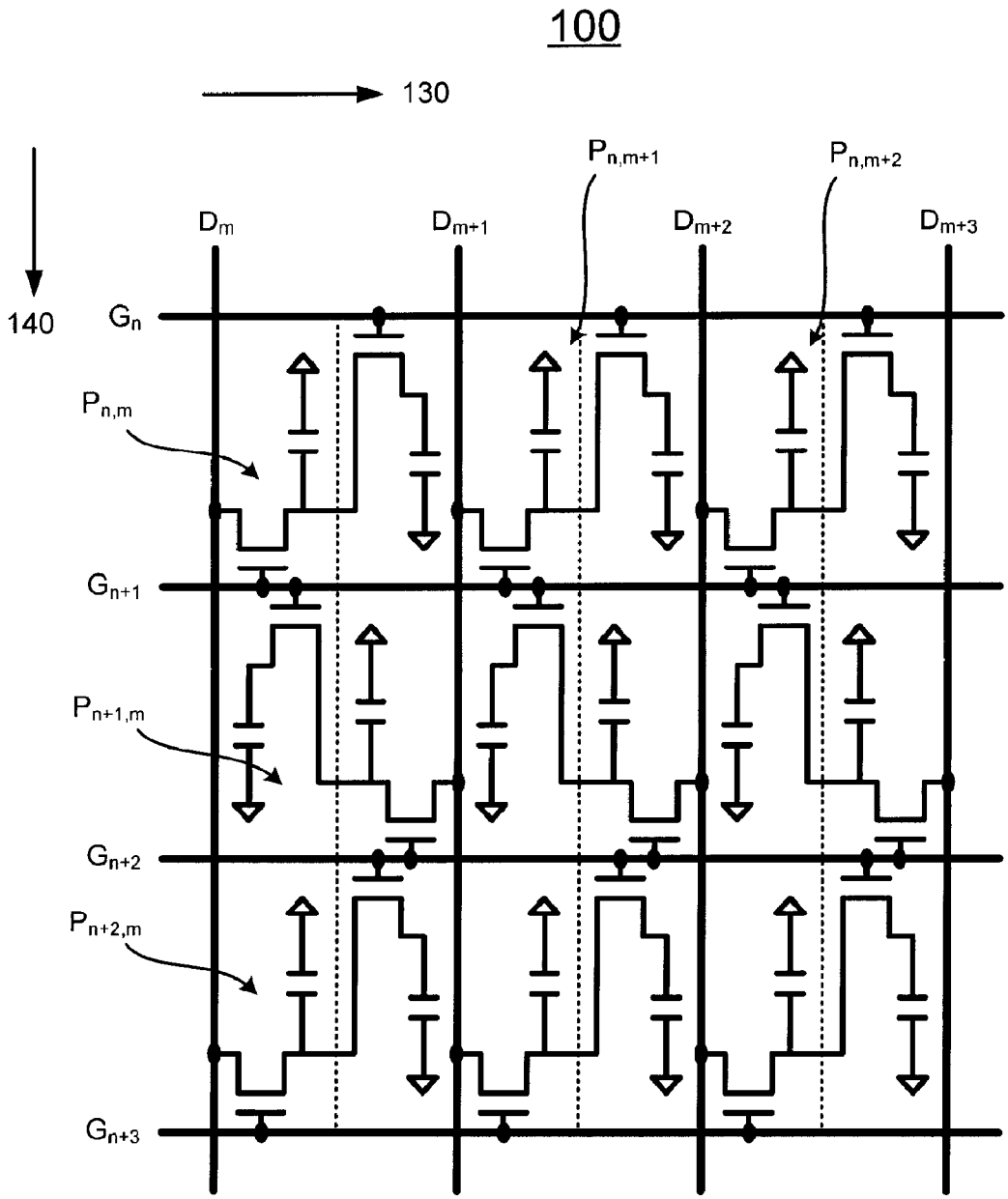
FIG. 1 shows schematically a partially equivalent circuit diagram of an LCD panel according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Additionally, some terms used in this specification are more specifically defined below.

The description will be made as to the embodiments of the present invention in conjunction with the accompanying drawings in FIGS. 1-16. In accordance with the purposes of this invention, as embodied and broadly described herein, this invention, in one aspect, relates to an LCD panel that utilizes a column inversion data driving scheme to reduce power consumption and methods of driving same.

Figure 2:
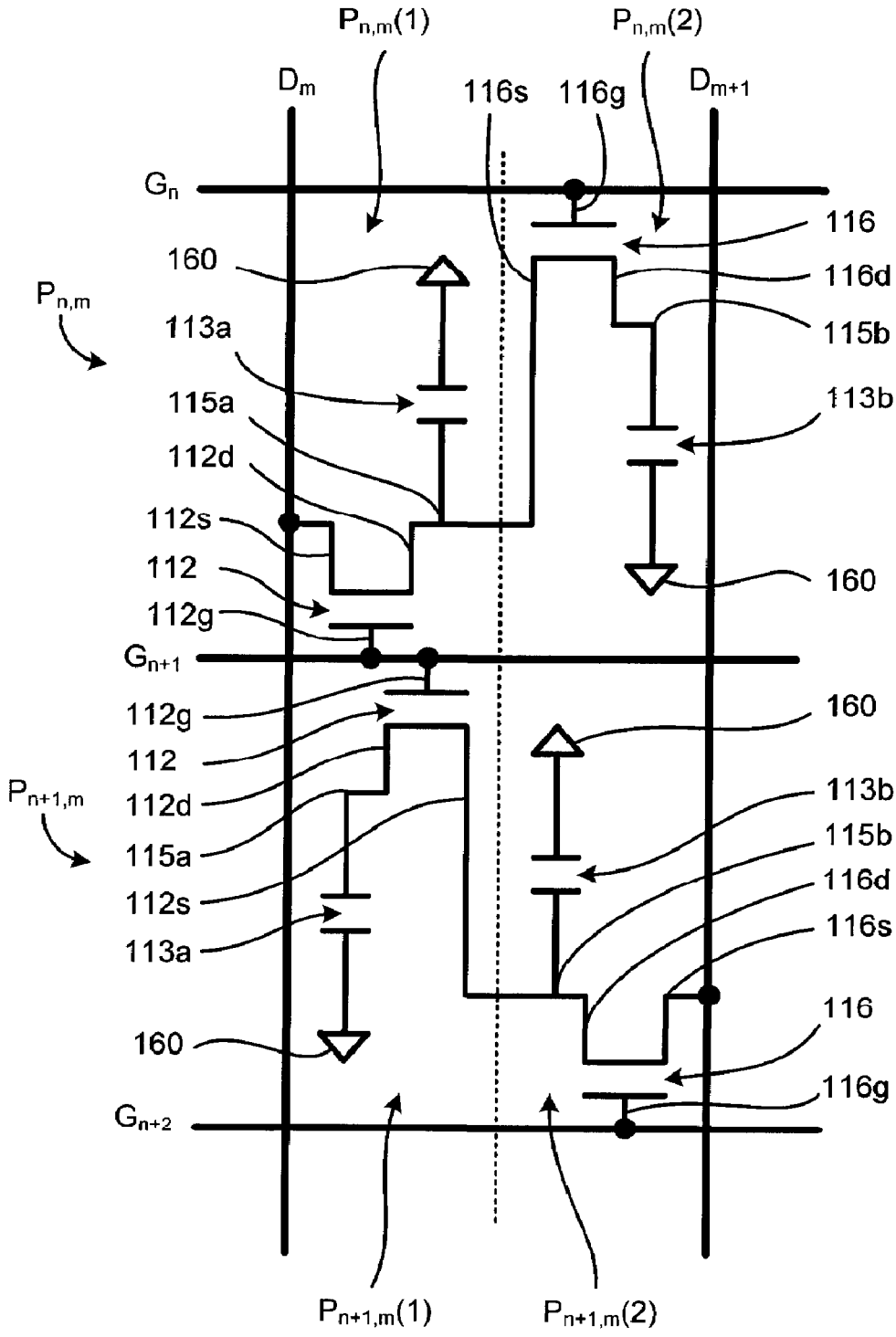
FIG. 2 shows schematically another partially equivalent circuit diagram of the LCD panel shown in FIG. 1.
Figure 3:
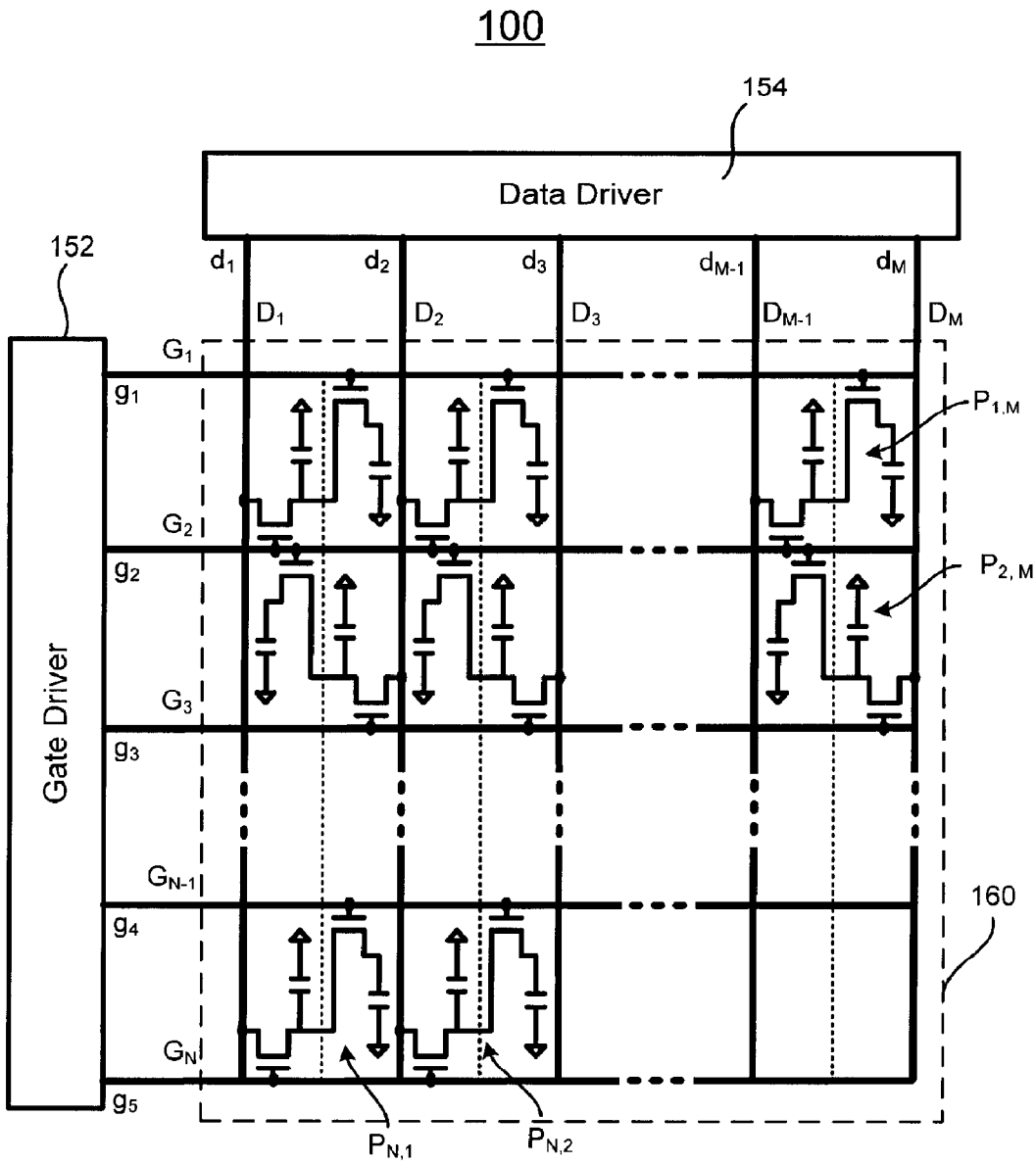
FIG. 3 shows schematically the equivalent circuit diagram of the LCD panel shown in FIG. 1, with a gate driver and a data driver.

Referring to FIGS. 1-3, an LCD panel 100 according to one embodiment of the present invention is partially and schematically shown. The LCD panel 100 includes a common electrode 160, a plurality of scanning lines, $G_1, G_2, \ldots, G_n, G_{n+1}, G_{n+2}, G_{n+3} \ldots, G_N$, that are spatially arranged along a row (scanning) direction 130, and a plurality of data lines, $D_1, D_2, \ldots, D_m, D_{m+1}, D_{m+2}, D_{m+3}, \ldots, D_M$, that are spatially arranged crossing the plurality of scanning lines $G_1, G_2 \ldots, G_n, G_{n+1}, G_{n+2}, G_{n+3}, \ldots, G_N$ along a column direction 140 that is perpendicular to the row direction 130. N and M are integers greater than one. The LCD panel 100 further has a plurality of pixels, $\{P_{n,m}\}$, that is spatially arranged in the form of a matrix. Each pixel $P_{n,m}$ is defined between two neighboring scanning lines $G_n$ and $G_{n+1}$ and two neighboring data lines $D_m$ and $D_{m+1}$. For the purpose of illustration of embodiments of the present invention, FIG. 1 schematically shows only four scanning lines $G_n$, $G_{n+1}$, $G_{n+2}$ and $G_{n+3}$, four data lines $D_m$, $D_{m+1}$, $D_{m+2}$ and $D_{m+3}$, and nine corresponding pixels of the LCD panel 100. FIG. 2 schematically shows only three scanning lines $G_n$, $G_{n+1}$ and $G_{n+2}$, two data lines $D_m$ and $D_{m+1}$, and two corresponding pixels $P_{n,m}$ and $P_{n+1,m}$ of the LCD panel 100.

Furthermore, each pixel $P_{n,m}$ is configured to have two or more sub-pixels. As shown in FIG. 2, a pixel $P_{n,m}$ located, for example, between two neighboring scanning lines $G_n$ and $G_{n+1}$ and two neighboring data lines $D_m$ and $D_{m+1}$ crossing the two neighboring scanning lines $G_n$ and $G_{n+1}$, has a first sub-pixel, $P_{n,m}(\mathbf{1})$, and a second sub-pixel, $P_{n,m}(\mathbf{2})$. Each of the first sub-pixel $P_{n,m}(\mathbf{1})$ and the second sub-pixel $P_{n,m}(\mathbf{2})$ comprises a sub-pixel electrode 115*a*/115*b*, a liquid crystal (LC) capacitor 113*a*/113*b* and a transistor 112/116 having a gate 112*g*/116*g*, a source 112*s*/116*s* and a drain 112*d*/116*d*.

The LC capacitor 113*a* of the first sub-pixel $P_{n,m}(\mathbf{1})$ of the pixel $P_{n,m}$ is electrically connected between the sub-pixel electrode 115*a* of the first sub-pixel $P_{n,m}(\mathbf{1})$ of the pixel $P_{n,m}$ and the common electrode 160 in parallel. The LC capacitor 113*b* of the second sub-pixel $P_{n,m}(\mathbf{2})$ of the pixel $P_{n,m}$ is electrically connected between the sub-pixel electrode 115*b* of the second sub-pixel $P_{n,m}(\mathbf{2})$ of the pixel $P_{n,m}$ and the common electrode 160 in parallel. Additionally, each of the first sub-pixel $P_{n,m}(\mathbf{1})$ and the second sub-pixel $P_{n,m}(\mathbf{2})$ of the pixel $P_{n,m}$ may have a storage capacitor electrically connected between the sub-pixel electrode 115*a*/115*b* of the corresponding sub-pixel $P_{n,m}(\mathbf{1})/P_{n,m}(\mathbf{2})$ of the pixel $P_{n,m}$ and the common electrode 160 in parallel (not shown), for providing coupling voltages to the corresponding LC capacitor 113*a*/113*b* to compensate for charge leakages therefrom.

The gate 112*g* and the source 112*s* of the transistor 112 of the first sub-pixel $P_{n,m}(\mathbf{1})$ of the pixel $P_{n,m}$ are electrically coupled to the scanning line $G_{n+1}$ and the data line $D_m$, respectively, and the gate 116*g* and the source 116*s* of the transistor 116 of the second sub-pixel $P_{n,m}(\mathbf{2})$ of the pixel $P_{n,m}$ are electrically coupled to the scanning line $G_n$ and the sub-pixel electrode 115*a* of the first sub-pixel $P_{n,m}(\mathbf{1})$, respectively.

The gate 112*g* and the source 112*s* of the transistor 112 of the first sub-pixel $P_{n+1,m}(\mathbf{1})$ of the pixel $P_{n+1,m}$ are electrically coupled to the scanning line $G_{n+1}$ and the sub-pixel electrode 115*b* of the second sub-pixel $P_{n+1,m}(\mathbf{2})$, respectively, and the gate 116*g* and the source 116*s* of the transistor 116 of the second sub-pixel $P_{n+1,m}(\mathbf{2})$ of the pixel $P_{n+1,m}$ are electrically coupled to the scanning line $G_{n+2}$ and the data line $D_{m+1}$, respectively.

In one embodiment, the sub-pixel electrodes 115*a*/115*b* of the first sub-pixel $P_{n,m}(\mathbf{1})$ and the second sub-pixel $P_{n,m}(\mathbf{2})$ of each pixel $P_{n,m}$ are deposited on a first substrate (not shown), while the common electrode 160 is deposited on a second substrate (not shown) that is spatially apart from the first substrate. The LC molecules are filled into cells between the first and second substrates. Each cell is associated with a pixel $P_{n,m}$ of the LCD panel 100. Voltages (potentials) applied to the sub-pixel electrodes control orientational alignments of the LC molecules in the LC cells associated with the corresponding sub-pixels.

The transistor 112 and the transistor 116 in one embodiment are field-effect TFTs and adapted for activating the first sub-pixel $P_{n,m}(\mathbf{1})$ and the second sub-pixel $P_{n,m}(\mathbf{2})$, respectively. Other types of transistors may also be utilized to practice the present invention. When the transistor 112 and the transistor 116 are selected to be turned on by a scanning signal applied through the scanning line $G_n$ or the scanning line $G_{n+1}$ to which the gate 112*g* of the transistor 112 and the gate 116*g* of the transistor 116 are electrically coupled, a data signal applied through the corresponding data line $D_m$ or the corresponding data line $D_{m+1}$ is incorporated into the first sub-pixel $P_{n,m}(\mathbf{1})$ and the second sub-pixel $P_{n,m}(\mathbf{2})$ by means of charging the corresponding LC capacitors 113*a* and 113*b* of the first sub-pixel $P_{n,m}$(1) and the second sub-pixel $P_{n,m}$(2), respectively. The charged potentials of the LC capacitors 113*a* and 113*b* of the first sub-pixel $P_{n,m}$(1) and the second sub-pixel $P_{n,m}$(2) of the pixel $P_{n,m}$ are corresponding to the electrical fields applied to corresponding liquid crystal cells between the first and second substrates.

The LCD panel 100 further has a gate driver 152 and a data driver 154, as shown in FIG. 3. The gate driver 152 is adapted for generating a plurality of scanning signals, $\{g_n\}$, respectively applied to the plurality of scanning lines $\{G_n\}$. The plurality of scanning signals $\{g_n\}$ is configured to turn on the transistors 112/116 connected to the plurality of scanning lines $\{G_n\}$ in a predefined sequence. The data driver 154 is adapted for generating a plurality of data signals, $\{d_m\}$, respectively applied to the plurality of data lines $\{D_m\}$. The plurality of data signals $\{d_m\}$ is configured such that any two neighboring data signals $d_m$ and $d_{m+1}$ have inverted polarities, i.e., if the data signal $d_m$ has a positive/high voltage, then the data signal $d_{m+1}$ has a negative/low voltage, and vice versus.

For such a pixel arrangement and a driving scheme, data of an image to be displayed is applied to the plurality of data lines $\{D_m\}$ in the column inversion, while the image display in the plurality of pixels $\{P_{n,m}\}$ is in the dot inversion, which has high quality of display. Because each data line $D_m$ is electrically coupled to both the pixel column $P_{\{n\},m}$ and its neighboring pixel column $P_{\{n\},m+1}$, only half number of data lines $\{D_m\}$ may be needed in order to achieve the dot inversion in the LCD panel 100, comparing to that of a conventional LCD panel of the dot inversion. Accordingly, the LCD panel 100 may save as much as half of power consumption of the conventional LCD panel of the dot inversion.

Figure 4:
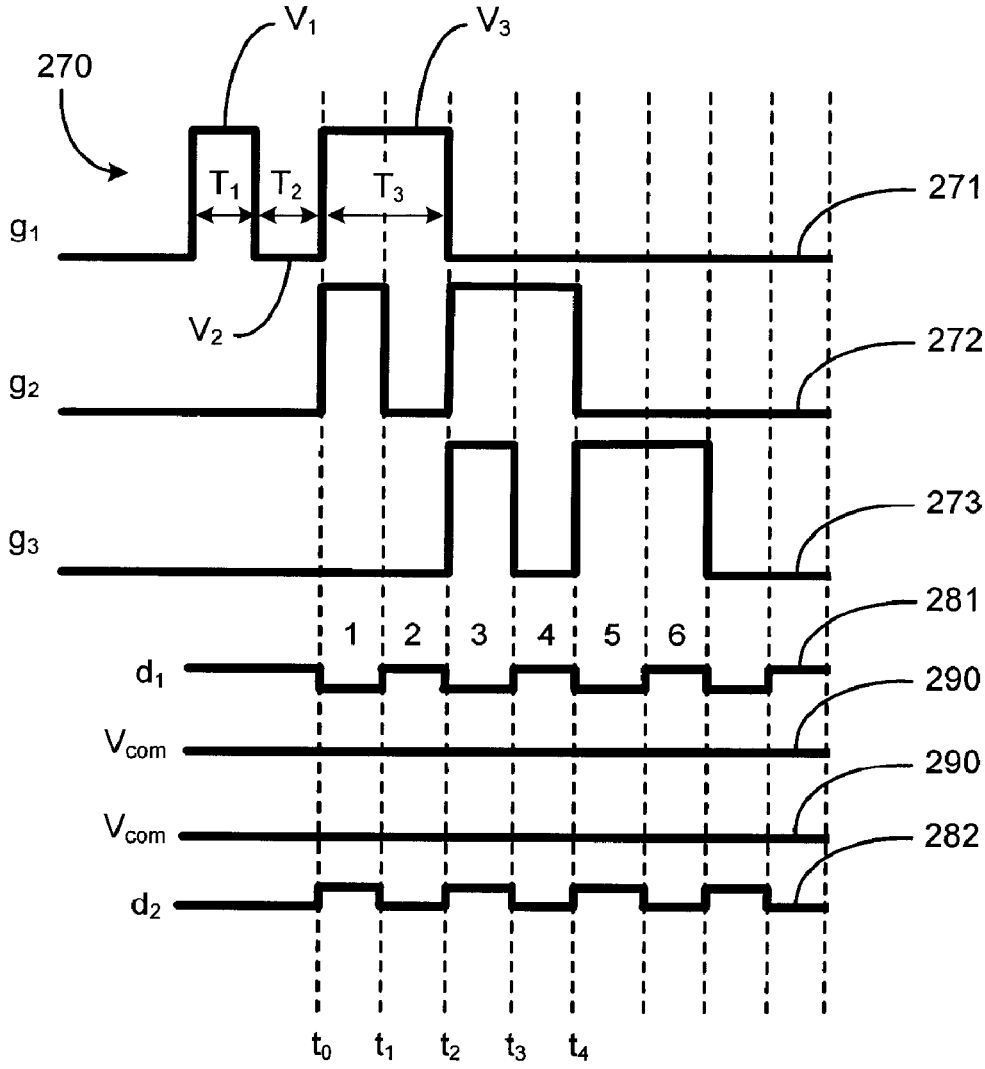
FIG. 4 shows time charts of driving signals applied to the LCD panel shown in FIG. 1.
Figure 5:
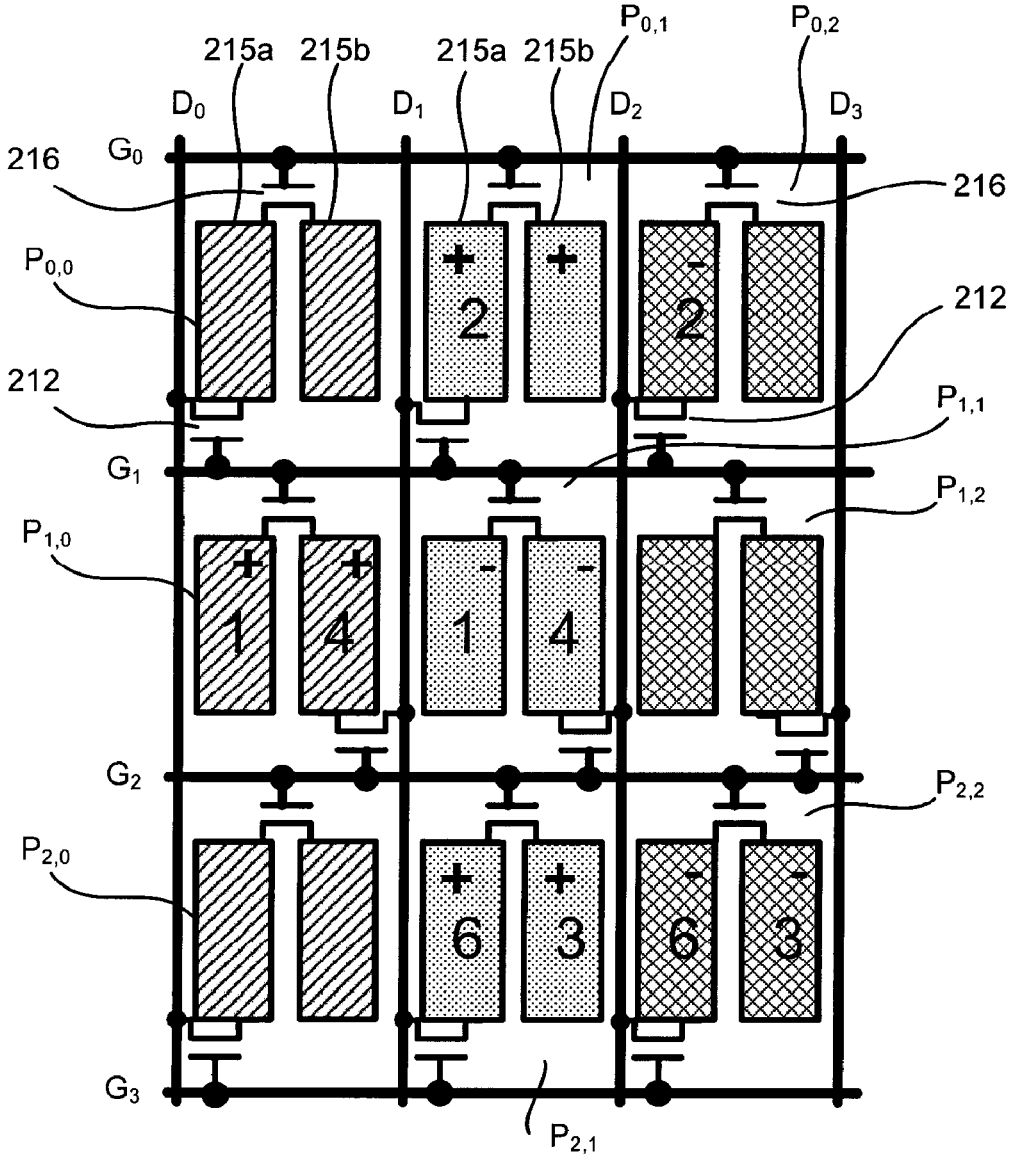
FIG. 5 shows schematically a partial layout view of the LCD panel shown in FIG. 1.

Referring to FIGS. 4 and 5, waveform charts of the driving signals applied to the LCD panel 200 and charging in the corresponding sub-pixel electrodes 215*a* and 215$_b$ of the LCD panel 200 are shown according to one embodiment of the present invention. In the exemplary embodiment, the LCD panel 200 is shown schematically and partially with 3×3 pixels, where the pixels, for example, in the first column of the 3×3 pixel matrix are referenced by $P_{0,0}$, $P_{1,0}$ and $P_{2,0}$, respectively. Each pixel has a first sub-pixel electrode 215*a*, a second sub-pixel electrode 215*b*, a first transistor (switching device) 212 and a second transistor (switching device) 216, each transistor 212 or 216 having a gate, a source and a drain. The gates of both the first transistor 212 and the second transistor 216 of each pixel are electrically connected to a pair of two neighboring scanning lines, respectively, by which the pixel is defined, such as $G_0$ and $G_1$, $G_1$ and $G_2$ or $G_2$ and $G_3$. The drains of the first transistor 212 and the second transistor 216 of each pixel are electrically connected to the first sub-pixel electrode 215*a* and the second sub-pixel electrode 215*b* of the pixel, respectively.

For the pixels $P_{0,0}$, $P_{0,1}$ and $P_{0,2}$ of the first pixel row defined by the pair of two neighboring scanning lines $G_0$ and $G_1$, the source of the first transistor 212 of each pixel $P_{0,0}$, $P_{0,1}$ or $P_{0,2}$ is electrically connected to a corresponding data line $D_0$, $D_1$ or $D_2$, while the source of the second transistor 216 of each pixel $P_{0,0}$, $P_{0,1}$ or $P_{O,2}$ is electrically connected to the first sub-electrode 215*a* of the pixel. However, for the pixels $P_{1,0}$, $P_{1,1}$ and $P_{1,2}$ of the second pixel row defined by the pair of two neighboring scanning lines $G_1$ and $G_2$, the source of the first transistor 212 of each pixel $P_{1,0}$, $P_{1,1}$, or $P_{1,2}$ is electrically connected to the second sub-electrode 215*b* of the pixel, while the source of the second transistor 216 of each pixel $P_{0,0}$, $P_{0,1}$ or $P_{0,2}$ is electrically connected to a corresponding data line $D_1$, $D_2$ or $D_3$. The pixel arrangement repeats in every two neighboring pixel rows, as shown in FIG. 5. The scanning line $G_0$ and the data line $D_0$ are usually adapted for inputting dummy signals therein.

In the exemplary embodiment, the driving signals include three scanning signals $g_1$ (271), $g_2$ (272) and $g_3$ (273) respectively applied to the scanning lines $G_1$, $G_2$ and $G_3$, and two data signals $d_1$ (281) and $d_2$ (282) respectively applied to the data lines $D_1$ and $D_2$, and a common signal Vcom (290) applied to the common electrode (not shown), respectively. The scanning signals 271, 272 and 273 are generated by a gate driver. Each of the scanning signals 271, 272 and 273 has a waveform 270. The waveform 270 has a first voltage potential $V_1$ in a first duration, $T_1$, a second voltage potential $V_2$ in a second duration, $T_2$, and a third voltage potential $V_3$ in a third duration, $T_3$, where the second duration $T_2$ is immediately after the first duration $T_1$, and the third duration $T_3$ is immediately after the second duration $T_2$. In one embodiment, as shown in FIG. 5, $V_1=V_3>V_2$, $T_1=T_2$, and $T_3=2T_1$. $V_1$ ($V_3$) and $V_2$ are corresponding to a high voltage potential and a low voltage potential, respectively, for effectively turning on and off the corresponding transistors of a corresponding pixel row. The waveform 270 of each of the scanning signals 271, 272 and 273 is sequentially shifted from one another so as to activate the three pixel rows in a predetermined sequence. In this exemplary embodiment, the scanning signal 272 is shifted by a duration of $T_1+T_2$ from the scanning signal 271, and the scanning signal 273 is shifted by the duration of $T_1+T_2$ from the scanning signal 272, respectively.

The common signal Vcom 290 has a constant potential (voltage). The data signals 281 and 282 are generated according to an image to be displayed on these pixels and have inverted polarities. That is, if the data signal 281 has a positive voltage, then the data signal 282 has a negative voltage, and vice versus. In the embodiment, the data signal 281 has a positive voltage. while the data signal 282 has a negative voltage.

As shown in FIG. 4, in the time period 1 of ($t_1$–$t_0$), the transistors 212 and 216 electrically connected to the scanning lines $G_1$ and $G_2$ are turned on, while the transistors 212 and 216 electrically connected to the scanning line $G_3$ are turned off, respectively. Accordingly, a positive voltage is generated in the first sub-pixel electrode 215*a* of the pixels $P_1$,o by application of the data signal 281 to the source of the second transistor 216 of the pixels $P_{1,0}$, while a negative voltage is generated the first electrode 215*a* of the pixel $P_{1,1}$ by application of the data signal 282 to the source of the second transistor 216 of the pixels $P_{1,1}$. As shown in FIG. 5, the generated positive voltage in the first sub-pixel electrode 215*a* of the pixels $P_{1,0}$ and the generated negative voltage in the first sub-pixel electrode 215*a* of the pixels $P_1$, are indicated by symbols "+" and "–" therein, respectively. Additionally, the numerals "1", "2", "3", "4" and "6" labeled in the sub-pixels $P_{1,0}$(1)/$P_{1,1}$(1), $P_{0,1}$(1)/$P_{0,2}$(1), $P_{2,1}$(2)/$P_{2,2}$(2), $P_{1,0}$(2)/$P_{1,1}$(2) and $P_{2,1}$(1)/$P_{2,2}$(1) in the FIG. 5 respectively refers to the time periods 1, 2, 3, 4 and 6 when the corresponding sub-pixel is charged.

In the time period 2 of ($t_2$–$t_1$), the transistors 212 and 216 electrically connected to the scanning line $G_1$ are turned on, while the transistors 212 and 216 electrically connected to the scanning lines $G_2$ and $G_3$ are turned off, respectively. Accordingly, a positive voltage is generated in the first sub-pixel electrode 215*a* of the pixel $P_{0,1}$ by application of the data signal 281 to the source of the first transistor 212 of the pixel $P_{0,1}$, while a negative voltage is generated in the first sub-pixel electrode 215*a* of the pixel $P_{0,2}$ by application of the data signal 282 to the source of the first transistor 212 of the pixel $P_{0,2}$. As shown in FIG. 5, the generated positive voltage in the first sub-pixel electrode 215*a* of the pixels $P_{0,1}$ and the generated negative voltage in the first sub-pixel electrode 215*a* of the pixels $P_{0,1}$ are indicated by symbols "+" and "−" therein, respectively.

As shown in FIG. 5, in the time period 3 of $(t_3-t_2)$, the transistors 212 and 216 electrically connected to the scanning lines $G_2$ and $G_3$ are turned on, while the transistors 212 and 216 electrically connected to the scanning line $G_1$ are turned off, respectively. Accordingly, a positive voltage is generated in the second sub-pixel electrode 215*b* of the pixels $P_{2,1}$ by application of the data signal 281 to the source of the first transistor 212 of the pixel $P_{2,1}$, and a negative voltage is generated in the second sub-pixel electrode 215*b* of the pixels $P_{2,2}$ by application of the data signal 282 to the source of the first transistor 212 of the pixel $P_{2,2}$, which are indicated by symbols "+" and "−" therein, respectively.

Accordingly, for this pixel arrangement and driving scheme, the dot inversion is achieved in the pixel matrix $\{P_{n,m}\}$ of the LCD panel 200 for the image display, with the data inputting into the data lines in the column inversion.

Figure 6:
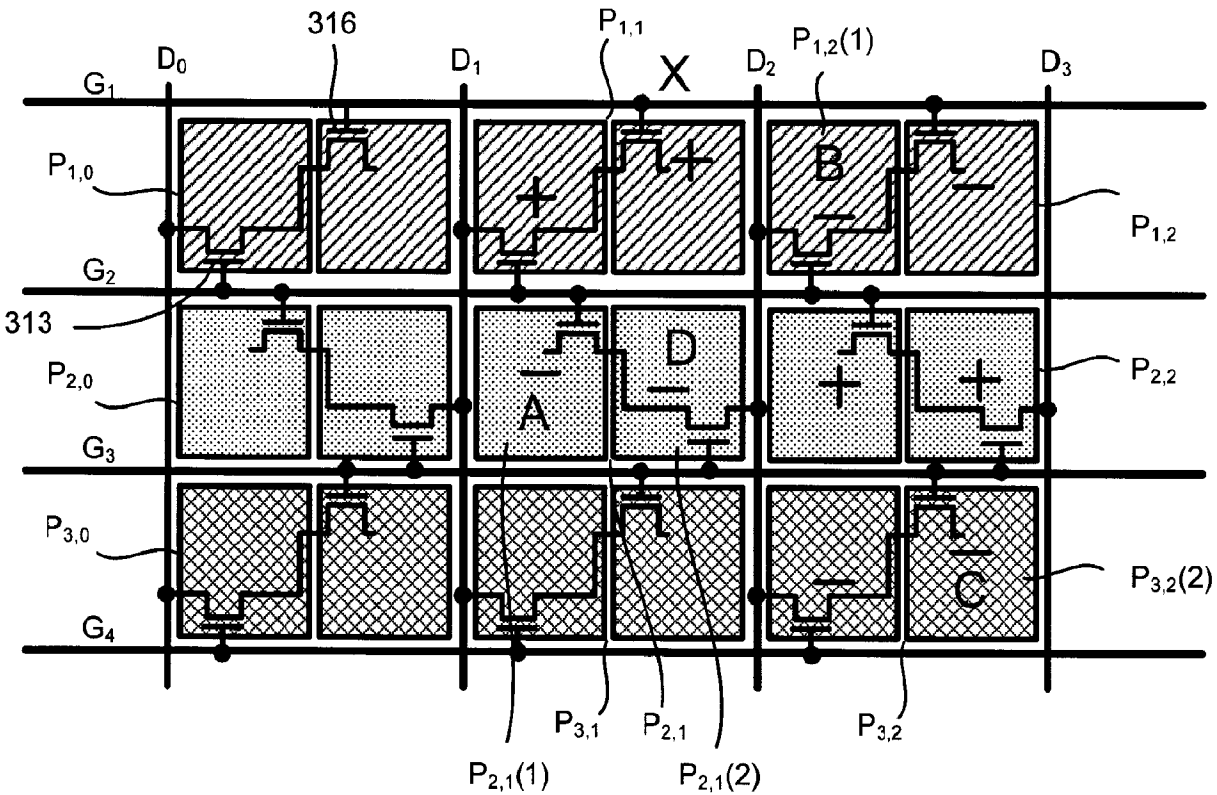
FIG. 6 shows schematically an another partial layout view of the LCD panel shown in FIG. 1.
Figure 7:
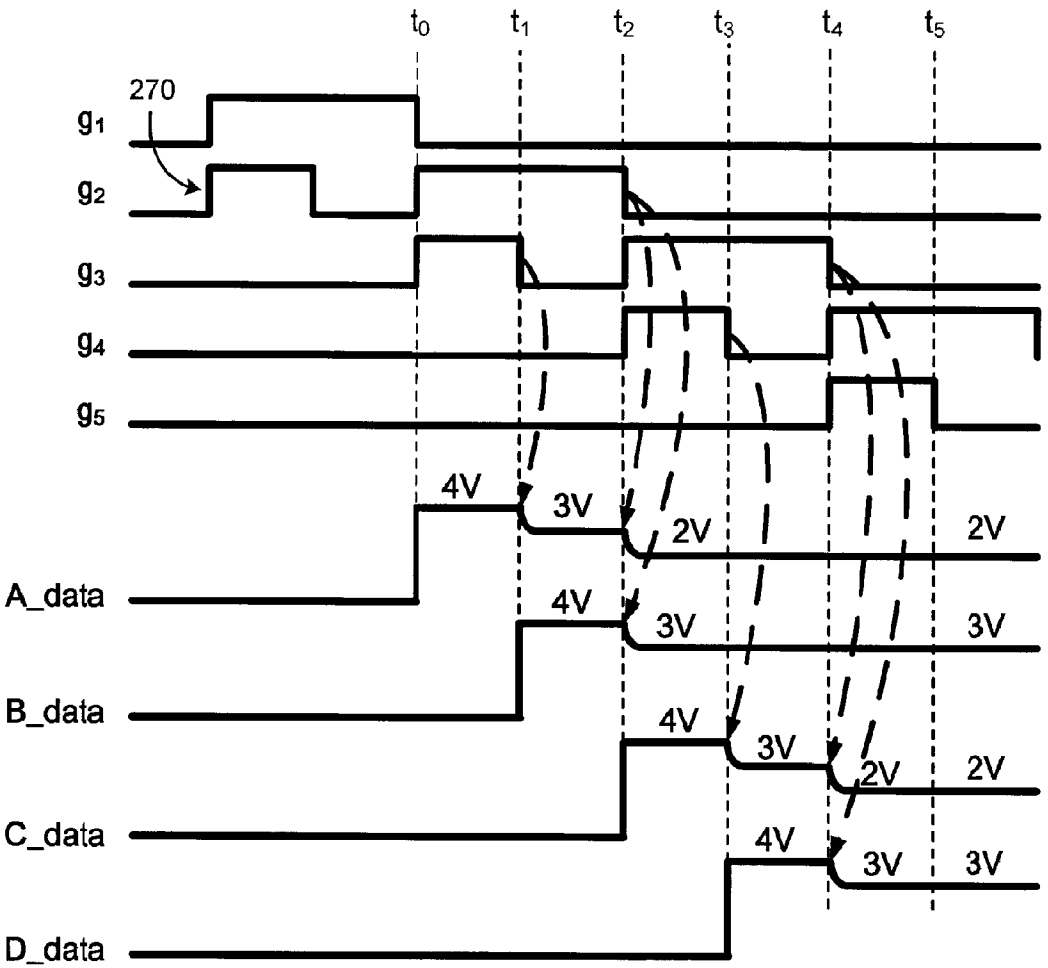
FIG. 7 shows time charts of the scanning signals shown in FIG. 4 and corresponding pixel voltage potentials of the LCD panel shown in FIG. 6.

However, the simplified waveform (pulses) and their timing sequence (gate timing) in the scanning signals $g_1$, $g_2$ and $g_3$ as shown in FIG. 4 may cause a mura effect in the LCD panel of the present invention in display, since charging/discharging some sub-pixels of the LCD panel may generate a first feed through, while charging/discharging other sub-pixels of the LCD panel may generate a first and second feed through. FIGS. 6 and 7 show the effects of the multi-gate pulse and the order of turning-off gates on an LCD panel 300 of the present invention in display, where $g_1$, $g_2$, . . . , and $g_5$ are the scanning signals applied to the scanning lines $G_1$, $G_2$, . . . and $G_5$, respectively, and A_data, B_data, C_data and D_data represent the voltage potential of the sub-pixels A, B, C and D, respectively. In this example, it is assumed that each of four sub-pixels A ($P_{2,1}$(1)), B ($P_{1,2}$(1)), C ($P_{3,2}$(2)) and D ($P_{2,1}$(2)) will be charged to 4V and each feed through is about 1V. The pixel arrangement in the LCD panel 300 partially shown in FIG. 6 is substantially identical to that in the LCD panel partially shown in FIG. 5.

In operation, in the time period of $(t_1-t_0)$, the gates $G_2$ and $G_3$ are turned on, i.e., the transistors 312 and 316 electrically connected to the scanning lines $G_2$ and $G_3$ are turned on, the sub-pixel A is charged to 4V by applying the data signal through the data line $D_2$. At time $t_1$, the gate $G_3$ is turned off, which generates a first feed though in the sub-pixel A, thereby reducing A data to 3V thereafter. Meantime, the sub-pixel B is charged to 4V. Then, at time $t_2$, the gate $G_2$ is turned off as well, which generates a second feed through in the sub-pixel A and a first feed through in the sub-pixel B, respectively, thereby reducing A_data to 2V and B_data to 3 V, respectively, thereafter. In the time period of $(t_3-t_2)$, the gates $G_3$ and $G_4$ are turned on, the sub-pixel C is charged to 4V. At time $t_3$, the gate $G_4$ is turned off, which generates a first feed though in the sub-pixel C, thereby reducing C_data to 3V thereafter. Meantime, the sub-pixel D is charged to 4V. Then, at time $t_4$, the gate G3 is turned off as well, which generates a second feed through in the sub-pixel C and a first feed through in the sub-pixel D, respectively, thereby reducing C_data to 2V and D_data to 3 V, respectively, thereafter.

The non-uniformity of the potential voltages in the sub-pixels A and B, and C and D cause the mura effect, a defect in intensity in displayed images. In order to get rid of the mura effect, the gate timing needs being modified such that the gates are turned on and/or turned off in a predetermined order. This can be implemented by modulating the waveform of the scanning signals $g_1$, $g_2$, . . . , $g_N$ applied to the scanning lines $G_1$, $G_2$, . . . , $G_N$, respectively.

Figure 8:
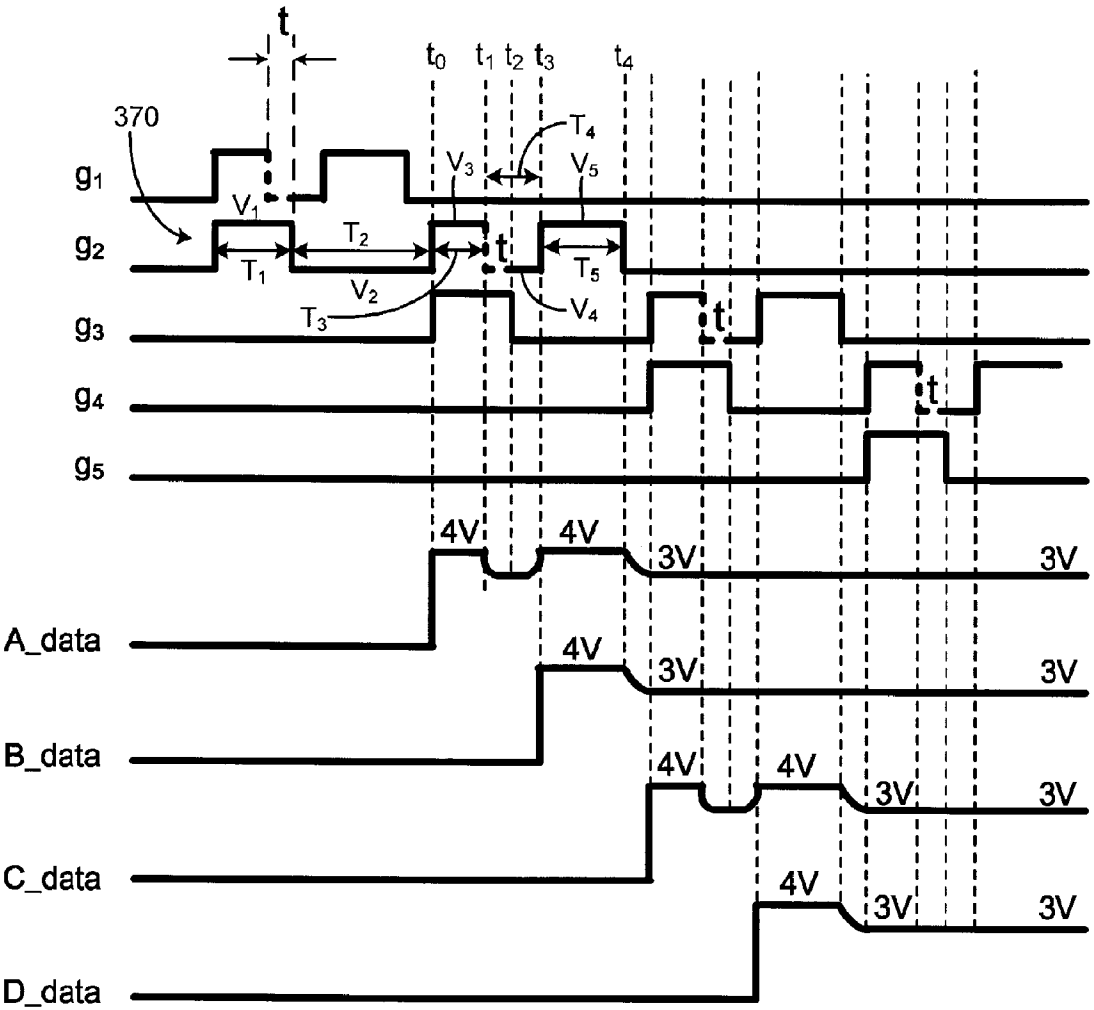
FIG. 8 shows time charts of scanning signals according to one embodiment of the present invention and corresponding pixel voltage potentials of the LCD panel shown in FIG. 6.

FIG. 8 shows the scanning signals according to one embodiment of the present invention. Each of the scanning signals $g_1$, $g_2$, . . . , $g_5$ is configured to have a waveform 370. The waveform 370 has a first voltage potential $V_1$ in a first duration, $T_1$, a second voltage potential $V_2$ in a second duration, $T_2$, a third voltage potential $V_3$ in a third duration, $T_3$, a fourth voltage potential $V_4$ in a fourth duration, $T_4$, and a fifth voltage potential $V_5$ in a fifth duration, $T_5$, where the (j+1)-th duration $T_{j+1}$ is immediately after the j-th duration $T_j$, j=1, 2, 3 and 4. In the exemplary embodiment, as shown in FIG. 8, $V_1=V_3=V_5>V_2=V_4$, $T_2=(T_1+2t)$, $T_3=(T_1-t)$, $T_4=2t$, $T_5=T_1$, and $T_1>>t$. In this embodiment, $V_1(V_3, V_5)$ and $V_2$ $(V_4)$ are corresponding to a high voltage potential and a low voltage potential, respectively, for effectively turning on and off the corresponding transistors of a corresponding pixel row. The waveform 370 of each of the scanning signals $g_1$, $g_2$, . . . , $g_5$ is sequentially shifted from one another so as to activate the three pixel rows in a predetermined order (sequence). In this exemplary embodiment, the scanning signal $g_2$ is shifted by a duration of $T_1+T_2$ from the scanning signal $g_1$, the scanning signal $g_3$ is shifted by the duration of $T_1+T_2$ from the scanning signal $g_2$, the scanning signal $g_4$ is shifted by the duration of $T_1+T_2$ from the scanning signal $g_3$, and the scanning signal $g_5$ is shifted by the duration of $T_1+T_2$ from the scanning signal $g_4$, respectively.

When such scanning signals $g_1$, $g_2$, . . . and $g_5$ are applied to the scanning lines $G_1$, $G_2$, . . . and $G_5$, respectively, each of the four sub-pixels A, B, C and D as shown in FIG. 6 will be charged to have a uniform voltage potential, thereby causing no mura effect to occur in the LCD panel 300 in operation. For example, in the time period of $(t_1-t_0)$, the gates $G_2$ and $G_3$ are turned on, the sub-pixel A is charged to 4V by applying the data signal through the data line $D_2$. At time $t_1$, the gate $G_2$ is turned off, which generates a feed though in the sub-pixel A, thereby reducing A data to 3V thereafter. At time $t_2$, the gate $G_3$ is turned off as well. However, the turning off of the gate $G_3$ generates no feed through in the sub-pixel A since the gate $G_2$ has already been turned off at this time $t_2$. The voltage potential of the sub-pixel A, A_data at time $t_2$ is still about 3V, as shown in FIG. 8. At time $t_3$, the gate $G_2$ is re-turned on, and the sub-pixel A is charged back to 4V again. Meanwhile, the sub-pixel B is charged to 4V. Then, at time $t_4$, the gate G2 is turned off, which generates a feed through in both the sub-pixels A and B. In this case, both A_data and B_data have an identical voltage potential, which is about 3V, as shown in FIG. 8.

Similarly, the voltage potentials of the sub-pixels C and D, C_data and D_data, are also about 3V, which are identical to that of the sub-pixels A and B.

Figure 9:
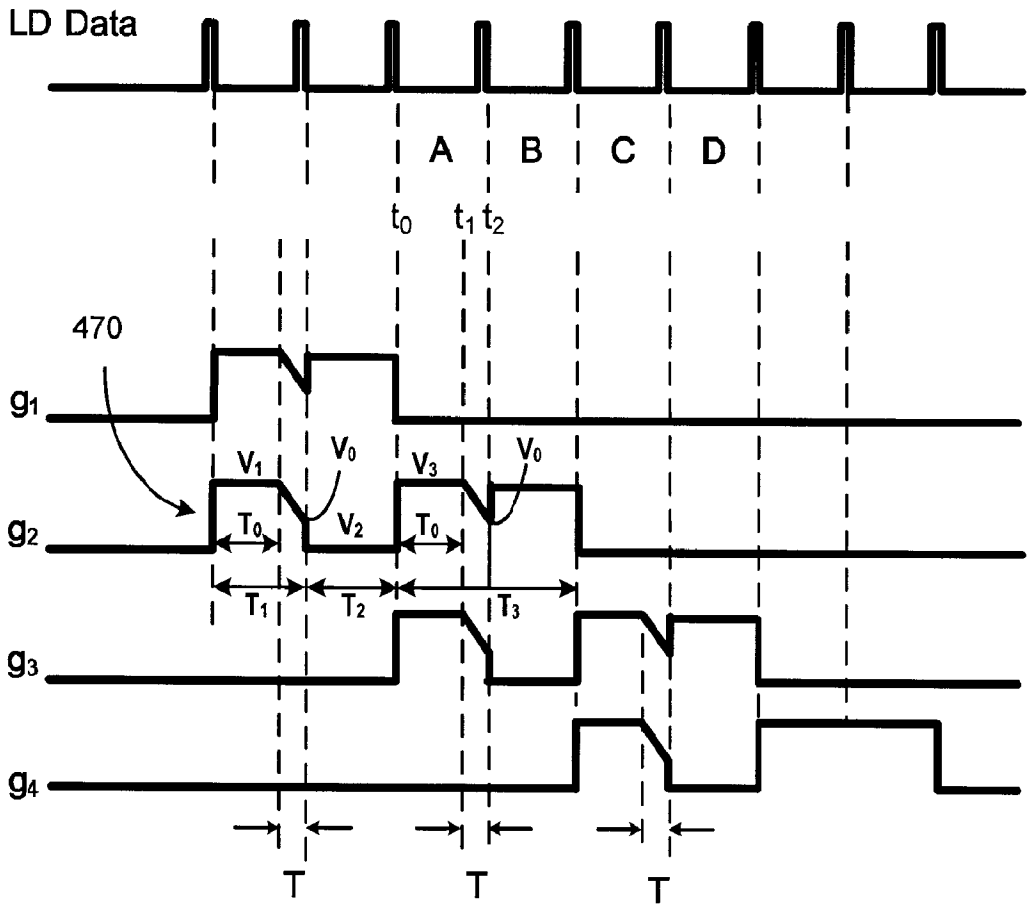
FIG. 9 shows time charts of scanning signals according to another embodiment of the present invention and corresponding pixel voltage potentials of the LCD panel shown in FIG. 6.

FIG. 9 shows the scanning signals according to another embodiment of the present invention. Each of the scanning signals $g_1$, $g_2$, $g_3$ and $g_4$ can be obtained by modulating (or angle-trimming) a corresponding scanning signal shown in FIGS. 4 and 7, such that the waveform 470 of each scanning signal has a first voltage potential $V_1(t)$ in a first duration, $T_1$, a second voltage potential $V_2(t)$ in a second duration, $T_2$, and a third voltage potential $V_3(t)$ in a third duration, $T_3$, where the second duration $T_2$ is immediately after the first duration $T_1$, and the third duration $T_3$ is immediately after the second duration $T_2$. $V_1(t)$ and $V_3(t)$ vary with time, while $V_2(t)=V_2$ is a constant and independent of time. As shown in FIG. 9, the first duration $T_1$ includes a first time period, $T_0$, and a second time period, $T=(T_1-T_0)$, immediately after the first time period $T_0$. In the first time period $T_0$, $V_1(t)=V$1, a constant voltage potential, while $V_1(t)$ continuously decreases from $V_1$ to $V_0$ as time goes in the second time period T. Additionally, the third duration $T_3$ includes a first time period, $T_0$, a second time period, T, immediately after the first time period $T_0$, and a third time period ($T_3-T_1-T_0$), immediately after the second time period T. For the voltage potential $V_3(t)$ in the third duration $T_3$, $V_3(t)=V_3$, a constant voltage potential, in the first time period $T_0$, in the second time period T, $V_3(t)$ continuously decreases from $V_3$ to $V_0$ as time goes and $V_3(t)=V_3$ in the third time period. In one embodiment, as shown in FIG. 9, $V_1=V_3>V_2$, $V_1>V_0\geqq V_2$, $T_1=T_2$, and $T_3=2T_1$. $V_1(V_3)$ and $V_2$ are corresponding to a high voltage potential and a low voltage potential, respectively, for effectively turning on and off the corresponding transistors of a corresponding pixel row. The waveform 470 of each of the scanning signals $g_1$, $g_2$, $g_3$ and $g_4$ is sequentially shifted from one another so as to activate the three pixel rows in a predetermined sequence. In this exemplary embodiment, the scanning signal $g_2$ is shifted by a duration of $T_1+T_2$ from the scanning signal $g_1$, the scanning signal $g_3$ is shifted by the duration of $T_1+T_2$ from the scanning signal $g_2$, and the scanning signal $g_4$ is shifted by the duration of $T_1+T_2$ from the scanning signal $g_3$, respectively.

When the scanning signals $g_1$, $g_2$, $g_3$ and $g_4$ are applied to the scanning lines $G_1$, $G_2$, $G_3$ and $G_4$, respectively, of the LCD panel 300, as shown in FIG. 6, the mura effect can be substantially reduced. For example, in the time period of ($t_1-t_0$), the gates $G_2$ and $G_3$ are turned on, the sub-pixel A is fully charged. Starting at time $t_1$, the gate $G_3$ is slowly being turned off till at time $t_2$, where $t_2=(t_1+T)$. Meanwhile, the gate $G_2$ is slowly being turned off as well, which substantially reduces the first feed through effect in the sub-pixel A generated by turning off the gate $G_3$. The longer the time period T is, the slower the gate $G_2$ is being turning off, the smaller the first feed through effect is in the sub-pixel A. Similarly, the first feed through effect in the sub-pixel C can also be substantially reduced. As a result, the mura effect in the LCD panel 300 is reduced.

Figure 10:
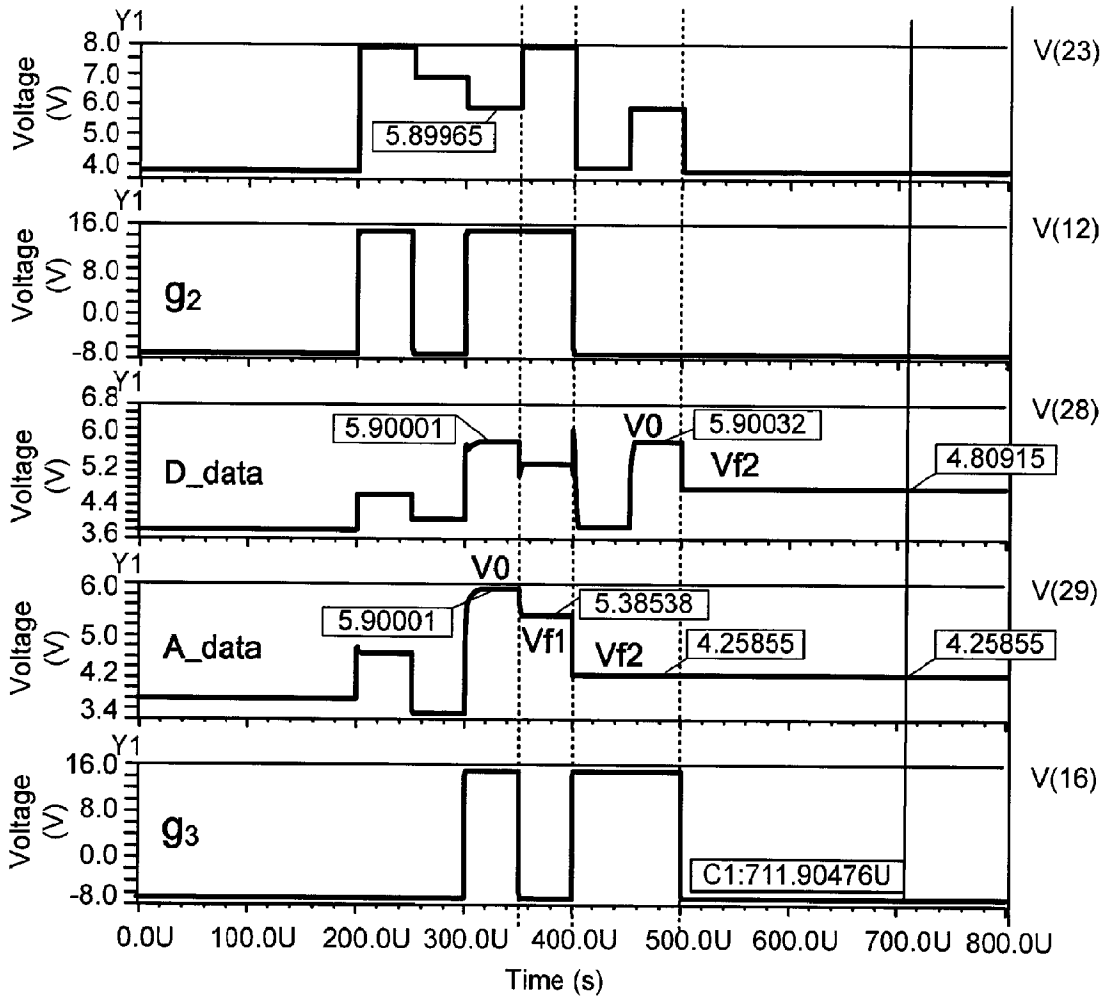
FIG. 10 shows simulation results of the pixel voltage potentials of the LCD panel for the scanning signals shown in FIG. 7.
Figure 11:
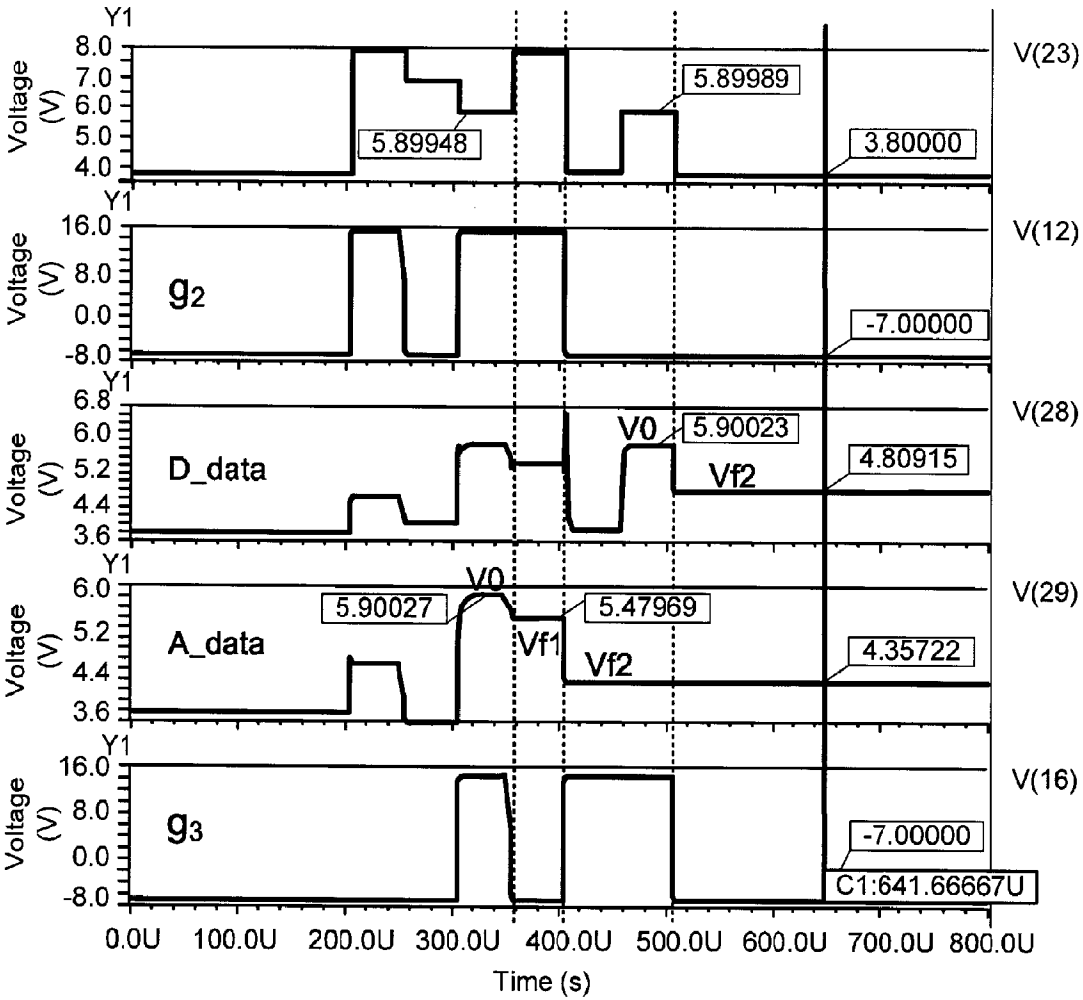
FIG. 11 shows simulation results of the pixel voltage potentials of the LCD panel for the scanning signals shown in FIG. 9.

FIG. 10 and Table 1 show a simulation result for the scanning signals having a waveform shown in FIGS. 4 and 7. The voltage potential difference between the sub-pixels A and D is $\Delta V=550$ mV FIG. 11 and Table 2 show a simulation result for the scanning signals having a waveform shown in FIG. 9. The voltage potential difference between the sub-pixels A and D is $\Delta V=450$ mV, which is smaller than 550 mV, the voltage potential difference between the sub-pixels A and D for the scanning signals having a waveform shown in FIGS. 4 and 7.

Figure 12:
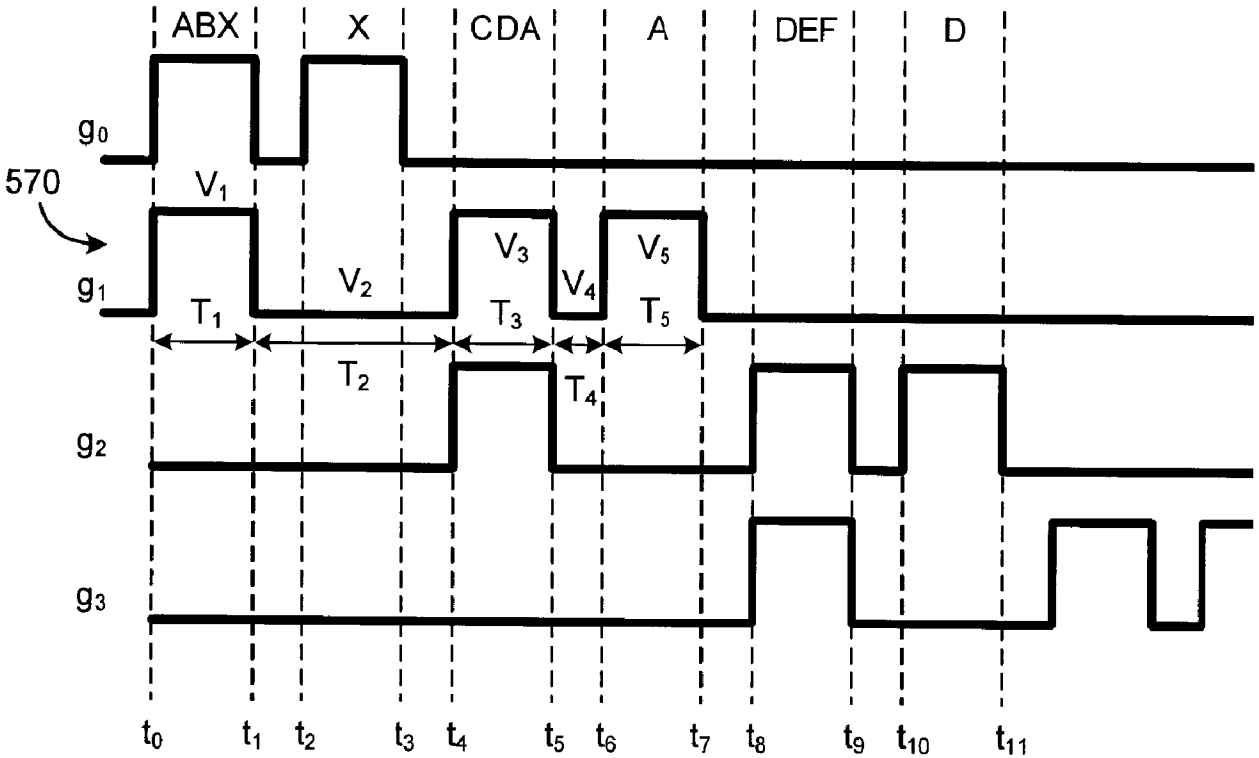
FIG. 12 shows time charts of scanning signals according to one embodiment of the present invention.
Figure 13:
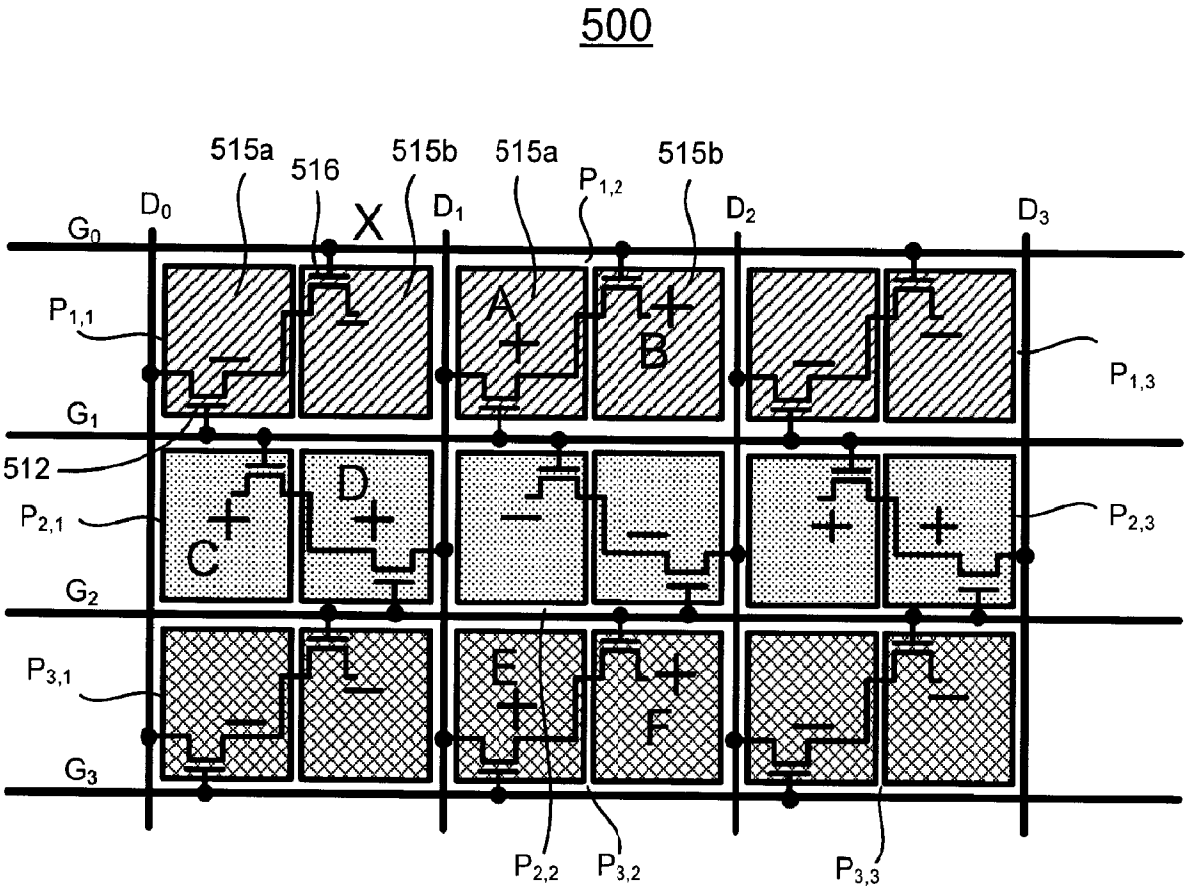
FIG. 13 shows schematically a partial layout view of the LCD panel shown in FIG. 1.

FIG. 12 shows waveform charts of scanning signals $g_0$, $g_1$, $g_2$ and $g_3$ applied to an LCD panel 500 and charging in the corresponding sub-pixel electrodes 515*a* and 515*b* of the LCD panel 500 according to one embodiment of the present invention. In the exemplary embodiment as shown in FIG. 13, the pixel arrangement/layout of the LCD panel 500 is same as that shown in FIG. 5. For the purpose of illustration of the present invention, the LCD panel 500 is shown schematically and partially with 3×3 pixels, where the pixels, for example, in the first column of the 3×3 pixel matrix are referenced by $P_{1,1}$, $P_{2,1}$ and $P_{3,1}$, respectively. Each pixel has a first sub-pixel electrode 515*a*, a second sub-pixel electrode 515*b*, a first transistor (switching device) 512 and a second transistor (switching device) 516, each transistor 512/516 having a gate, a source and a drain. The gates of both the first transistor 512 and the second transistor 516 of each pixel are electrically connected to a pair of two neighboring scanning lines, respectively, by which the pixel is defined, such as $G_0$ and $G_1$, $G_1$ and $G_2$ or $G_2$ and $G_3$. The drains of the first transistor 512 and the second transistor 516 of each pixel are electrically connected to the first sub-pixel electrode 515*a* and the second sub-pixel electrode 515*b* of the pixel, respectively.

TABLE 1

A simulation result for un-gate shaping

| Shaping Voltage | V0 | Vf1 | V1 | Vf2 | ΔV1 | ΔV2 | ΔVtotal |
|---|---|---|---|---|---|---|---|
| A | 5.9 | 5.385 | 5.385 | 4.258 | 0.515 | 1.127 | 1.542 |
| D | 5.9 | 5.9 | 5.9 | 4.809 | 0 | 1.091 | 1.091 |

TABLE 2

A simulation result for gate shaping

| Shaping Voltage | V0 | Vf1 | V1 | Vf2 | ΔV1 | ΔV2 | ΔVtotal |
|---|---|---|---|---|---|---|---|
| A | 5.9 | 5.479 | 5.479 | 4.357 | 0.421 | 1.122 | 1.543 |
| D | 5.9 | 5.9 | 5.9 | 4.809 | 0 | 1.091 | 1.091 |

For the pixels $P_{1,1}$, $P_{1,2}$ and $P_{1,3}$ of the first pixel row defined by the pair of two neighboring scanning lines $G_0$ and $G_1$, the source of the first transistor 512 of each pixel $P_{1,1}$, $P_{1,2}$ or $P_{1,3}$ is electrically connected to a corresponding data line $D_0$, $D_1$ or $D_2$, while the source of the second transistor 516 of each pixel $P_{1,1}$, $P_{1,2}$ or $P_{1,3}$ is electrically connected to the first sub-electrode 515*a* of the pixel. However, for the pixels $P_{2,1}$, $P_{2,2}$ and $P_{2,3}$ of the second pixel row defined by the pair of two neighboring scanning lines $G_1$ and $G_2$, the source of the first transistor 512 of each pixel $P_{2,1}$, $P_{2,2}$ or $P_{2,3}$ is electrically connected to the second sub-electrode 515*b* of the pixel, while the source of the second transistor 516 of each pixel $P_{1,1}$, $P_{1,2}$ or $P_{1,3}$ is electrically connected to a corresponding data line $D_1$, $D_2$ or $D_3$. The pixel arrangement repeats in every two neighboring pixel rows, as shown in FIG. 13.

In the exemplary embodiment, the driving signals include four scanning signals $g_0$, $g_1$ $g_2$, and $g_3$ respectively applied to the scanning lines $G_0$, $G_1$, $G_2$ and $G_3$. Each of the scanning signals $g_0$, $g_1$ $g_2$, and $g_3$ has a waveform 570. The waveform 570 has a first voltage potential $V_1$ in a first duration, $T_1$, a second voltage potential $V_2$ in a second duration, $T_2$, a third voltage potential $V_3$ in a third duration, $T_3$, a fourth voltage potential $V_4$ in a fourth duration, $T_4$, and a fifth voltage potential $V_5$ in a fifth duration, $T_5$, where the (+1)-th duration $T_{j+1}$ is immediately after the j-th duration $T_j$, j=1, 2, 3, and 4. In one embodiment, as shown in FIG. 13, $V_1=V_3=V_5>V_2=V_4$, $T_1=T_3=T_5$, and T2$=2T_1$, and $T_4<T_1$. In one embodiment, $V_1(V_3, V_5)$ and $V_2$ $(V_4)$ are corresponding to a high voltage potential and a low voltage potential, respectively, for effectively turning on and off the corresponding transistors of a corresponding pixel row. The waveform 570 of each of the scanning signals $g_0$, $g_1$ $g_2$, and $g_3$ is sequentially shifted from one another so as to activate the three pixel rows in a predetermined sequence. In this exemplary embodiment, the scanning signal $g_1$ is shifted by a duration of $T_1+T_2$ from the scanning signal $g_0$, the scanning signal $g_2$ is shifted by the duration of $T_1+T_2$ from the scanning signal $g_1$, and the scanning signal $g_3$ is shifted by the duration of $T_1+T_2$ from the scanning signal $g_2$, respectively.

The data signals $d_1$, $d_2$, $d_3$ and $d_4$ (not shown in FIG. 12) generated according to an image to be displayed on these pixels are configured to have inverted polarities and respectively applied to the data lines $D_0$, $D_1$, $D_2$ and $D_3$.

Accordingly, for such a pixel arrangement and driving scheme, the dot inversion is achieved in the pixel matrix $\{P_{n,m}\}$ of the LCD panel 500 for the image display, with the data inputting into the data lines in the column inversion.

FIG. 13 shows an example how the data signal $d_1$ having a positive voltage is delivered to corresponding sub-pixels of the LCD panel 500.

In the time period of $(t_1-t_0)$, only the transistors 512 and 516 electrically connected to the scanning lines $G_0$ and $G_1$ are turned on, the data signal $d_1$ is transmitted through the sub-pixels A, B and X. Eventually, the data signal $d_1$ is delivered to the sub-pixel B (the second sub-pixel 515*b* of the pixel $P_{1,2}$), which is indicated by symbol "+".

In the time period of $(t_2-t_1)$, none of the transistors 512 and 516 of the LCD panel 500 is turned on, thus, the data signal $d_1$ is delivered to nowhere.

In the time period of $(t_3-t_2)$, only the transistors 512 and 516 electrically connected to the scanning line $G_0$, then the data signal $d_1$ is delivered to the sub-pixel X.

In the time period of $(t_4-t_3)$, none of the transistors 512 and 516 of the LCD panel 500 is turned on, and the data signal $d_1$ is delivered to nowhere.

In the time period of $(t_5-t_4)$, only the transistors 512 and 516 electrically connected to the scanning lines $G_1$ and $G_2$, the data signal $d_1$ is transmitted through the sub-pixels A, C and D. Eventually, the data signal $d_1$ is delivered to the sub-pixel C (the first sub-pixel $P_{2,1}$(1) 515*a* of the pixel $P_{2,1}$).

In the time period of $(t_6-t_5)$, none of the transistors 512 and 516 of the LCD panel 500 is turned on, thus, the data signal $d_1$ is delivered to nowhere.

In the time period of $(t_7-t_6)$, only the transistors 512 and 516 electrically connected to the scanning line $G_1$, thus the data signal $d_1$ is delivered to the sub-pixel A (the first sub-pixel $P_{1,2}$(1) 515*a* of the pixel $P_{1,2}$).

In the time period of $(t_8-t_7)$, none of the transistors 512 and 516 of the LCD panel 500 is turned on, thus, the data signal $d_1$ is delivered to nowhere.

In the time period of $(t_9-t_8)$, only the transistors 512 and 516 electrically connected to the scanning lines $G_2$ and $G_3$, the data signal $d_1$ is transmitted through the sub-pixels D, E and F. Eventually, the data signal $d_1$ is delivered to the sub-pixel F (the second sub-pixel $P_{3,2}$(2) 515*b* of the pixel $P_{3,2}$).

In the time period of $(t_{10}-t_9)$, none of the transistors 512 and 516 of the LCD panel 500 is turned on, and the data signal $d_1$ is delivered to nowhere.

In the time period of $(t_{11}-t_{10})$, only the transistors 512 and 516 electrically connected to the scanning line $G_2$, thus the data signal $d_1$ is delivered to the sub-pixel D (the second sub-pixel $P_{2,1}$(2) 515*b* of the pixel $P_{2,1}$).

Repeating the process for the other data signals results in the dot inversion of display in the LCD panel 500, as shown in FIG. 13, where symbol "+" or "−" is used to indicate that a corresponding sub-pixel is charged with a positive voltage potential or a negative voltage potential, respectively.

According to the embodiments of the present invention as disclosed above, each data line is electrically coupled its two neighboring pixel columns, and the data signals applied to the corresponding data lines have voltages of alternating polarity, i.e., the column inversion, thus, only half number of data lines may be needed in order to achieve the dot inversion in the LCD panel, comparing to that of a conventional LCD panel of the dot inversion, which may significantly reduce the power consumption.

Figure 14:
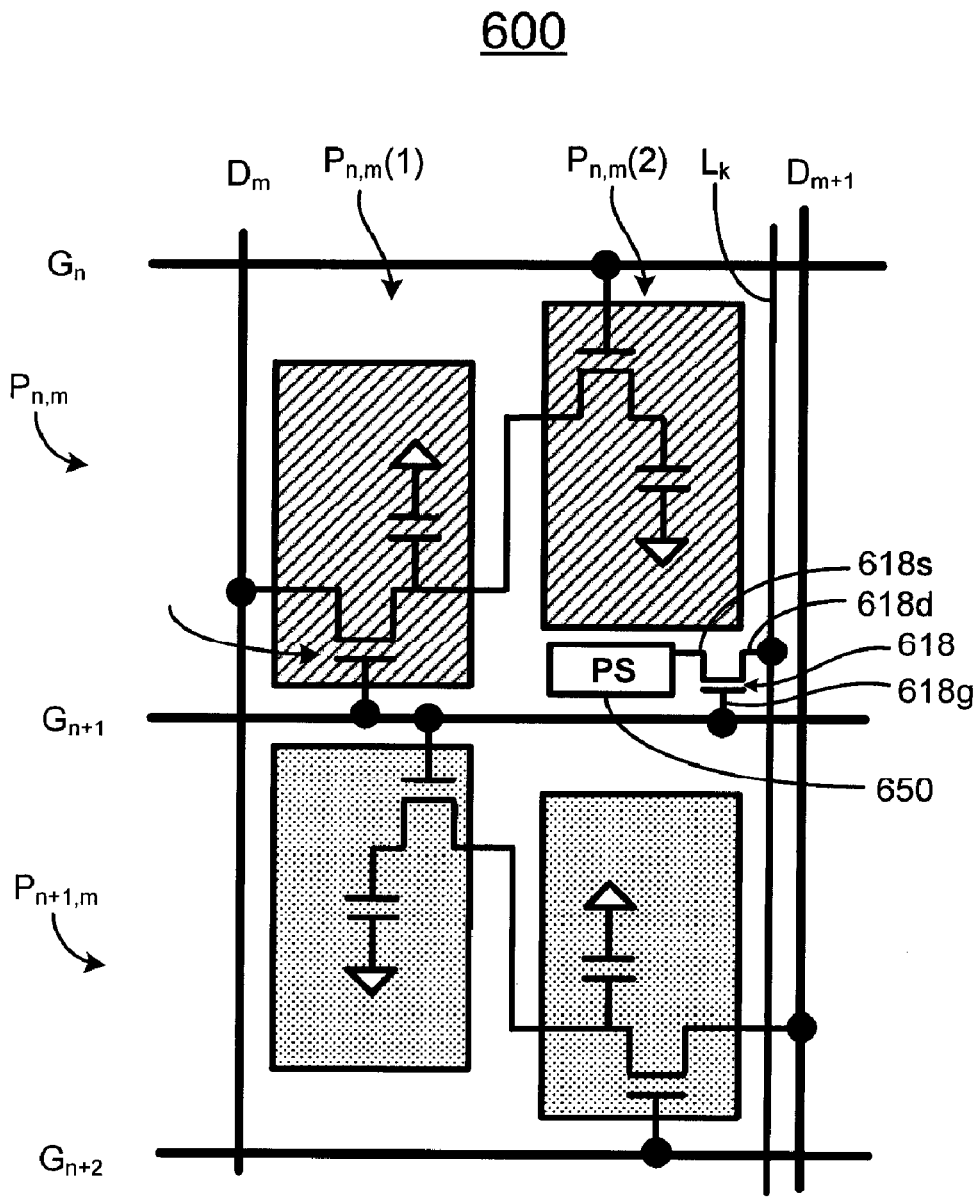
FIG. 14 shows schematically a partially equivalent circuit diagram of an LCD panel according to one embodiment of the present invention.

Referring to FIG. 14, an LCD panel 600 is shown according to another embodiment of the present invention. The LCD panel 600 includes a plurality of touch sensing signal lines $\{L_k\}$, integrated with the pixel arrangement of the LCD panel shown in FIG. 1, where k=1, 2, . . . , K, K being an integer greater than zero. The touch sensing signal line $L_k$ is arranged adjacent and parallel to the data line $D_{m+1}$. Other arrangements of the plurality of touch sensing signal lines $\{L_k\}$ can also be utilized to practice the present invention. For example, the touch sensing signal line $L_k$ can be arranged adjacent and parallel to the scanning line $D_m$ or $D_{m+1}$.

In one embodiment, each pixel in the even number pixel rows of the pixel matrix or each pixel in the odd number pixel rows of the pixel matrix further comprises a photo sensor (PS) and a transistor having a gate electrically connected to one of two corresponding scanning lines defining the pixel, a source electrically connected the photo sensor and a drain electrically connected to a corresponding touch sensing signal line. For example, as shown in FIG. 14, the pixel $P_{n,m}$ in the pixel row $P_{n,\{m\}}$ defined by the two scanning lines $D_n$ and $D_{n+1}$ further includes a PS 650 and a transistor 618 having a gate 618*g* electrically connected to the scanning line $D_{m+1}$, a source 618*s* electrically connected the PS 650 and a drain 618*d* electrically connected to the corresponding touch sensing signal line $L_k$.

Similarly, when the above discussed driving signals are applied to the LCD panel 600, a dot inversion image display is achieved. Because each data line $D_m$ is electrically coupled to both the pixel column $P_{\{n\},m}$ and its neighboring pixel column $P_{\{n\},m+1}$, only half number of data lines $\{D_m\}$ may be needed in order to achieve the dot inversion in the LCD panel 600, comparing to that of a conventional LCD panel of the dot inversion. Accordingly, the LCD panel 600 may save as much as half of power consumption of the conventional LCD panel of the dot inversion.

Figure 15:
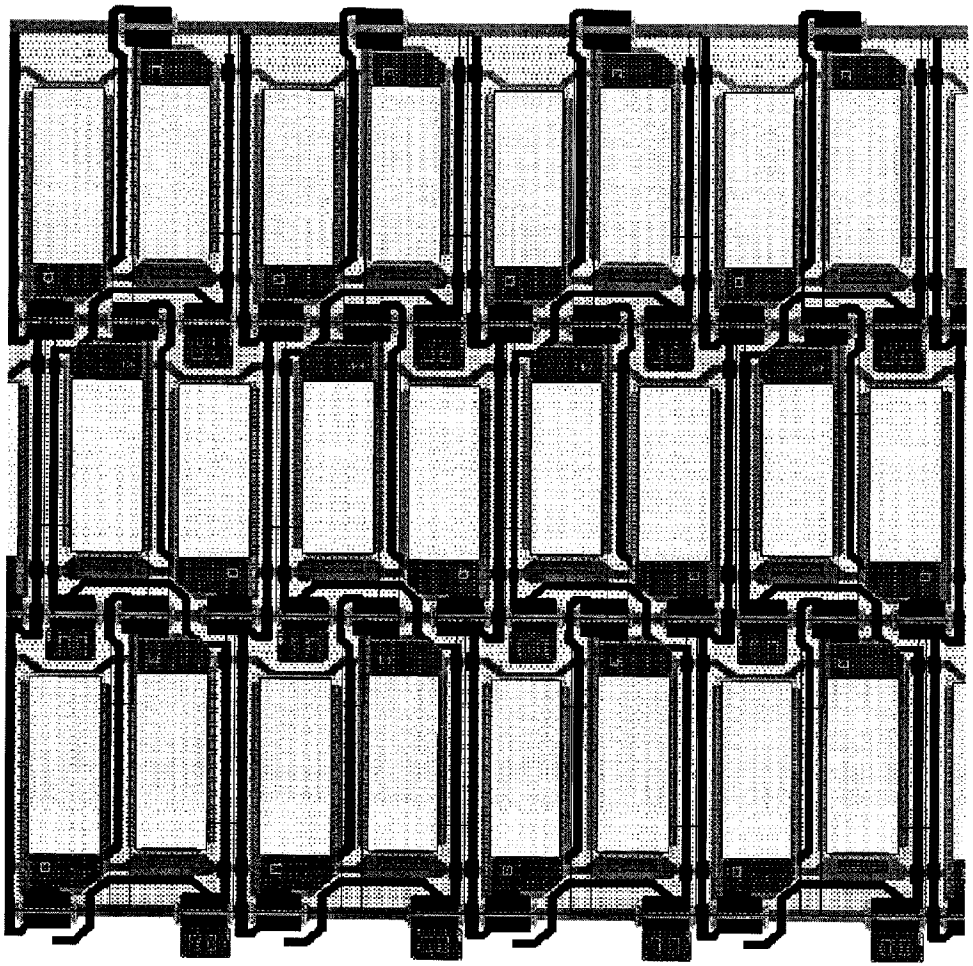
FIG. 15 shows schematically a partial layout view of the LCD panel shown in FIG. 14.
Figure 16:
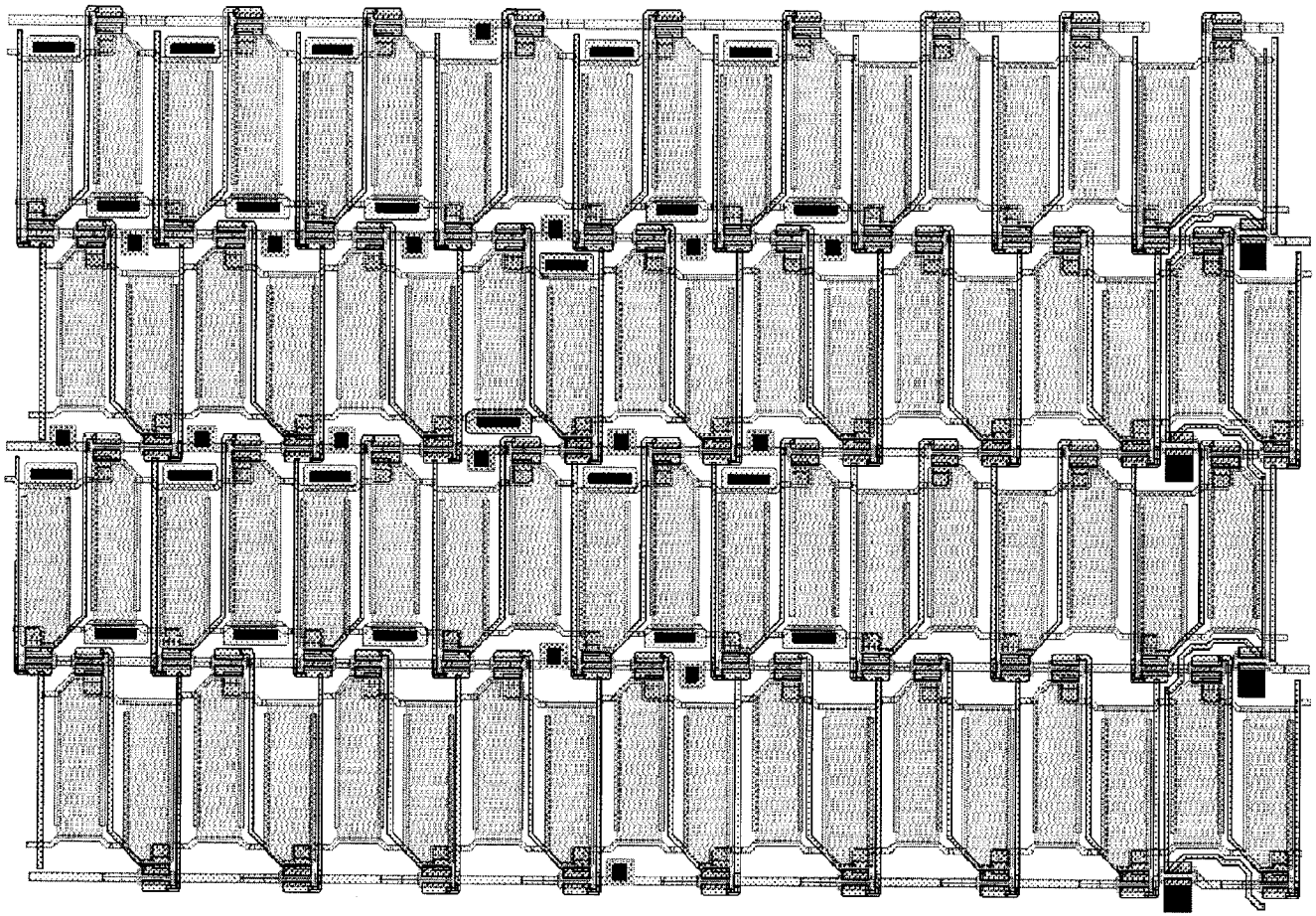
FIG. 16 shows schematically another partial layout view of the LCD panel shown in FIG. 14.

FIGS. 15 and 16 show schematically layout views of the LCD panel according to two embodiments of the present invention, respectively.

One aspect of the present invention provides an LCD panel having a plurality of pixels, $\{P_{n,m}\}$, spatially arranged in the form of a matrix, n=1, 2, . . . , N, and m=1, 2, . . . , M, and N, M being an integer greater than zero. Each pixel $P_{n,m}$ has at least a first sub-pixel, $P_{n,m}$(1) and a second sub-pixel, $P_{n,m}$(2), where each of the first sub-pixel $P_{n,m}$(1) and the second sub-pixel $P_{n,m}$(2) comprises a sub-pixel electrode and a switching element electrically coupled to the sub-pixel electrode. The switching element is a field-effect thin film transistor (TFT), or the like.

The LCD panel also has a plurality of scanning lines, $\{G_n\}$, spatially arranged along a row direction. Each pair of two neighboring scanning lines $G_n$ and $G_{n+1}$, defines a pixel row $P_{n,\{m\}}$ of the pixel matrix $\{P_{n,m}\}$ therebetween and is electrically coupled to the switching elements of the first sub-pixel and the second sub-pixel of each pixel in the pixel row $P_{n,\{m\}}$, respectively.

The LCD panel further has a plurality of data lines, $\{D_m\}$, spatially arranged crossing the plurality of scanning lines $\{G_n\}$ along a column direction perpendicular to the row direction. Each pair of two neighboring data lines $D_m$ and $D_{m+1}$ defines a pixel column, $P_{\{n\},m}$, of the pixel matrix $\{P_{n,m}\}$ therebetween. Each data line $D_m$ is electrically coupled to the switching element of the first sub-pixel or the second sub-pixel of each odd pixel of one of two neighboring pixel columns P{n},m−1 and P{n},m associated with the data line $D_m$ and to the switching element of the second sub-pixel or the first sub-pixel of each even pixel of the other of the two neighboring pixel columns $P_{\{n\},m-1}$ and $P_{\{n\},m}$.

Additionally, the LCD panel may have a plurality of touch sensing signal lines $\{L_k\}$, k=1, 2, . . . , K, K being an integer greater than zero. Each touch sensing signal line is arranged adjacent and parallel to a scanning line $G_n$ or a data line $D_m$. In one embodiment, each pixel in the even number pixel rows of the pixel matrix or each pixel in the odd number pixel rows of the pixel matrix further comprises a photo sensor (PS) and a transistor having a gate electrically connected to one of two corresponding scanning lines defining the pixel, a source electrically connected the photo sensor and a drain electrically connected to a corresponding touch sensing signal line.

Furthermore, the LCD panel has a gate driver for generating a plurality of scanning signals respectively applied to the plurality of scanning lines $\{G_n\}$, where the plurality of scanning signals is configured to turn on the switching elements connected to the plurality of scanning lines $\{G_n\}$ in a predefined sequence; and a data driver for generating a plurality of data signals respectively applied to the plurality of data lines $\{D_m\}$, where the plurality of data signals is configured such that any two neighboring data signals have inverted polarities. The plurality of pixels $\{P_{n,m}\}$ has a pixel polarity that is in the dot inversion.

Another aspect of the present invention provides a method of driving a liquid crystal display (LCD) panel as disclosed above. The method includes the step of applying a plurality of scanning signals to the plurality of scanning lines $\{G_n\}$ and a plurality of data signals to the plurality of data lines $\{D_m\}$, respectively. The plurality of scanning signals is configured to turn on the transistors connected to the plurality of scanning lines $\{G_n\}$ in a predefined sequence, and the plurality of data signals is configured such that any two neighboring data signals have inverted polarities. As a result, the plurality of pixels $\{P_{n,m}\}$ has a pixel polarity that is in the dot inversion.

In sum, the present invention, among other things, discloses a liquid crystal display (LCD) panel with power consumption reduction and methods of driving same. The LCD panel in one embodiment includes a pixel matrix, a plurality of scanning lines and a plurality of data lines. Each pair of two neighboring scanning lines defines a pixel row therebetween, and each pair of two neighboring data lines defines a pixel column therebetween. Each pixel has at least a first sub-pixel and a second sub-pixel. Each sub-pixel has a sub-pixel electrode and a switching element electrically coupled to the sub-pixel electrode. Each pair of two neighboring scanning lines is electrically coupled to the switching elements of the first sub-pixel and the second sub-pixel of each pixel in the pixel row, respectively. Each data line is electrically coupled to the switching element of the first sub-pixel or the second sub-pixel of each odd pixel of one of two neighboring pixel columns associated with the data line and to the switching element of the second sub-pixel or the first sub-pixel of each even pixel of the other of the two neighboring pixel columns. The LCD panel further includes a gate driver and a data driver for generating scanning signals and data signals applied to the plurality of scanning lines and the plurality of data lines, respectively. The scanning signals are configured to turn on the switching elements connected to the plurality of scanning lines in a predefined sequence, and the data signals are configured such that any two neighboring data signals have inverted polarities.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A method of driving a liquid crystal display (LCD), comprising the steps of:

(a) providing an LCD panel comprising:

(i) a common electrode;

(ii) a plurality of scanning lines, $\{G_n\}$, n=1, 2, . . . , N, N being an integer greater than zero, spatially arranged along a row direction;

(iii) a plurality of data lines, $\{D_m\}$, m=1, 2, . . . , M, M being an integer greater than zero, spatially arranged crossing the plurality of scanning lines $\{G_n\}$ along a column direction perpendicular to the row direction; and (iv) a plurality of pixels, $\{P_{n,m}\}$, spatially arranged in the form of a matrix, each pixel $P_{n,m}$ defined between two neighboring scanning lines $G_n$ and $G_{n+1}$ and two neighboring data lines $D_m$, and $D_{m+1}$, and comprising at least a first sub-pixel, $P_{n,m}(\mathbf{1})$, and a second sub-pixel, $P_{n,m}(\mathbf{2})$, wherein each of the first sub-pixel and the second sub-pixel comprises a sub-pixel electrode, a liquid crystal (LC) capacitor electrically coupled between the sub-pixel electrode and the common electrode in parallel, and a transistor having a gate, a source and a drain electrically coupled to the sub-pixel electrode, wherein the gate and the source of the transistor of the first sub-pixel $P_{n,m}(\mathbf{1})$ of the pixel $P_{n,m}$ are electrically coupled to the scanning line $G_{n+1}$ and the data line $D_m$, respectively, and wherein the gate and the source of the transistor of the second sub-pixel $P_{n,m}(\mathbf{2})$ of the pixel $P_{n,m}$ are electrically coupled to the scanning line $G_n$ and the sub-pixel electrode of the first sub-pixel $P_{n+1,m}(\mathbf{1})$, respectively; and wherein the gate and the source of the transistor of the first sub-pixel $P_{n-1,m}$m(1) of the pixel $P_{n-1,m}$ are electrically coupled to the scanning line $G_{n+1}$ and the sub-pixel electrode of the second sub-pixel $P_{n+1,m}(\mathbf{2})$, respectively, and wherein the gate and the source of the transistor of the second sub-pixel $P_{n+1,m}(\mathbf{2})$ of the pixel $P_{n+1,m}$ are electrically coupled to the scanning line $G_{n-2}$ and the data line $D_{m-1}$, respectively; and (b) applying a plurality of scanning signals to the plurality of scanning lines $\{G_n\}$ and a plurality of data signals to the plurality of data lines $\{D_m\}$, respectively, wherein the plurality of scanning signals is configured to turn on the transistors connected to the plurality of scanning lines $\{G_n\}$ in a predefined sequence, and the plurality of data signals is configured such that any two neighboring data signals have inverted polarities.

2. The method of claim 1, wherein each of the plurality of scanning signals is configured to have a waveform, wherein the waveform has a first voltage potential $V_1$ in a first duration, $T_1$, a second voltage potential $V_2$ in a second duration, $T_2$, a third voltage potential $V_3$ in a third duration, $T_3$, a fourth voltage potential $V_4$ in a fourth duration, $T_4$, and a fifth voltage potential $V_5$ in a fifth duration, $T_5$, wherein the (j+1)-th duration $T_{j-1}$ is immediately after the j-th duration $T_j$, j=1, 2, 3 and 4, and wherein $V_1=V_3=V_5>V_2=V_4$, $T_2=(T_1+2t)$, $T_3=(T_1-t)$, $T_4=2t$, $T_5=T_1$, and $T_1>>t$.

3. The method of claim 2, wherein the waveform of each of the scanning signals is sequentially shifted from one another by a duration of $T_1+T_2$.

4. The method of claim 1, wherein each of the plurality of scanning signals is configured to have a waveform, wherein the waveform of each of the plurality of scanning signals has a first voltage potential $V_1(t)$ in a first duration, $T_1$, a second voltage potential $V_2(t)$ in a second duration, $T_2$, and a third voltage potential $V_3(t)$ in a third duration, $T_3$, wherein the second duration $T_2$ is immediately after the first duration $T_1$ and the third duration $T_3$ is immediately after the second duration $T_2$, and wherein $V_1(t)$ and $V_3(t)$ vary with time and $V_2(t)=V_2$ is a constant and independent of time.

5. The method of claim 4, wherein the first duration $T_1$ includes a first time period, $T_0$, and a second time period, $T=(T_1-T_0)$, immediately after the first time period $T_0$, wherein in the first time period $T_0$, $V_1(t)=V1$, a constant voltage potential, and $V_1(t)$ continuously decreases from $V_1$ to $V_0$ as time goes in the second time period T, and wherein the third duration $T_3$ includes a first time period, $T_0$, a second time period, T, immediately after the first time period $T_0$, and a third time period $(T_3-T_1-T_0)$, immediately after the second time period T, wherein $V_3(t)=V_3$, a constant voltage potential, in the first time period $T_0$, $V_3(t)$ continuously decreases from $V_3$ to $V_0$ as time goes in the second time period T, and $V_3(t)=V_3$ in the third time period, and wherein $V_1=V_3>V_2$, $V_1>V_0\geqq V_2$, $T_1=T_2$, and $T_3=2T_1$.

6. The method of claim 5, wherein the waveform of each of the scanning signals is sequentially shifted from one another by a duration of $T_1+T_2$.

7. The method of claim 1, wherein, in operation, the plurality of pixels $\{P_{n,m}\}$ has a pixel polarity that is in a dot inversion.

8. The method of claim 1, wherein each of the first sub-pixel $P_{n,m}(\mathbf{1})$ and the second sub-pixel $P_{n,m}(\mathbf{2})$ of the pixel $P_{n,m}$ further comprises a storage capacitor electrically coupled between the sub-pixel electrode and the common electrode in parallel.

9. The method of claim 1, wherein the LCD panel further comprises a plurality of touch sensing signal lines $\{L_k\}$, k=1, 2, . . . , K, K being an integer greater than zero, each being arranged adjacent and parallel to a scanning line $G_n$ or a data line $D_m$.

10. The method of claim 9, wherein each pixel in the even number pixel rows of the pixel matrix or each pixel in the odd number pixel rows of the pixel matrix further comprises a photo sensor (PS) and a transistor having a gate electrically connected to one of two corresponding scanning lines defining the pixel, a source electrically connected the photo sensor and a drain electrically connected to a corresponding touch sensing signal line.

11. A method of driving a liquid crystal display (LCD), comprising the steps of:

(a) providing an LCD panel comprising:

(i) a plurality of pixels, $\{P_{n,m}\}$, spatially arranged in the form of a matrix, n=1, 2, . . . , N, and m=1, 2, . . . , M, and N, M being an integer greater than zero, each pixel $P_{n,m}$ comprising at least a first sub-pixel, $P_{n,m}(\mathbf{1})$ and a second sub-pixel, $P_{n,m}(\mathbf{2})$, wherein each of the first sub-pixel $P_{n,m}(\mathbf{1})$ and the second sub-pixel $P_{n,m}(\mathbf{2})$ comprises a sub-pixel electrode and a switching element electrically coupled to the sub-pixel electrode;

(ii) a plurality of scanning lines, $\{G_n\}$, spatially arranged along a row direction, wherein each pair of two neighboring scanning lines $G_n$ and $G_{n+1}$ defines a pixel row $P_{n,\{m\}}$ of the pixel matrix $\{P_{n,m}\}$ therebetween and is electrically coupled to the switching elements of the first sub-pixel and the second sub-pixel of each pixel in the pixel row $P_{n,\{m\}}$, respectively; and (iii) a plurality of data lines, $\{D_m\}$, spatially arranged crossing the plurality of scanning lines $\{G_n\}$ along a column direction perpendicular to the row direction, wherein each pair of two neighboring data lines $D_m$ and $D_{m-1}$ defines a pixel column, $P_{\{n\},m}$, of the pixel matrix $\{P_{n,m}\}$ therebetween, and wherein each data line $D_m$ is electrically coupled to the switching element of the first sub-pixel or the second sub-pixel of each odd pixel of one of two neighboring pixel columns $P_{\{n\},m-1}$ and $P_{\{n\},m}$ associated with the data line $D_m$ and to the switching element of the second sub-pixel or the first sub-pixel of each even pixel of the other of the two neighboring pixel columns $P_{\{n\},m-1}$ and $P_{\{n\},m}$; and (b) applying a plurality of scanning signals to the plurality of scanning lines $\{G_n\}$ and a plurality of data signals to the plurality of data lines $\{D_m\}$, respectively, wherein the plurality of scanning signals is configured to turn on the switching elements connected to the plurality of scanning lines $\{G_n\}$ in a predefined sequence, and the plurality of data signals is configured such that any two neighboring data signals have inverted polarities.

12. The method of claim 11, wherein, in operation, the plurality of pixels $\{P_{n,m}\}$ has a pixel polarity that is in the dot inversion.

13. The method of claim 11, wherein the LCD panel further comprises at least one common electrode.

14. The method of claim 13, wherein each of the first sub-pixel $P_{n,m}(\mathbf{1})$ and the second sub-pixel $P_{n,m}(\mathbf{2})$ of the pixel $P_{n,m}$ of the pixel matrix $\{P_{n,m}\}$ further comprises an LC capacitor electrically coupled between the sub-pixel electrode and the common electrode in parallel.

15. The method of claim 14, wherein each of the first sub-pixel $P_{n,m}(\mathbf{1})$ and the second sub-pixel $P_{n,m}(\mathbf{2})$ of the pixel $P_{n,m}$ of the pixel matrix $\{P_{n,m}\}$ further comprises a storage capacitor electrically coupled between the sub-pixel electrode and the common electrode in parallel.

16. The method of claim 11, wherein each of the switching elements of the first sub-pixel $P_{n,m}(\mathbf{1})$ and the second sub-pixel $P_{n,m}(\mathbf{1})$ of the pixel $P_{n,m}$ of the pixel matrix $\{P_{n,m}\}$ is a field-effect thin film transistor having a gate, a source and a drain.

17. The method of claim 15, wherein the drain of the transistor of each of the first sub-pixel $P_{n,m}(\mathbf{1})$ and the second sub-pixel $P_{n,m}(\mathbf{2})$ of each pixel $P_{n,m}$ of the pixel matrix $\{P_{n,m}\}$ is electrically coupled to the sub-pixel electrode of the corresponding sub-pixel;

wherein the gate and the source of the transistor of the first sub-pixel $P_{n,m}(\mathbf{1})$ of the pixel $P_{n,m}$ of the pixel matrix $\{P_{n,m}\}$ are electrically coupled to the scanning line $G_{n+1}$ and the data line $D_m$, respectively;

wherein the gate and the source of the transistor of the second sub-pixel $P_{n,m}(\mathbf{2})$ of the pixel $P_{n,m}$ of the pixel matrix $\{P_{n,m}\}$ are electrically coupled to the scanning line $G_n$ and the sub-pixel electrode of the first sub-pixel $P_{n,m}(\mathbf{1})$, respectively;

wherein the gate and the source of the transistor of the first sub-pixel $P_{n+1,m}(\mathbf{1})$ of the pixel $P_{n-1,m}$ of the pixel matrix $\{P_{n,m}\}$ are electrically coupled to the scanning line $G_{n+1}$ and the sub-pixel electrode of the second sub-pixel $P_{n-1,m}(\mathbf{2})$, respectively; and wherein the gate and the source of the transistor of the second sub-pixel $P_{n+1,m}(\mathbf{2})$ of the pixel $P_{n+1,m}$ of the pixel matrix $\{P_{n,m}\}$ are electrically coupled to the scanning line $G_{n+2}$ and the data line $D_{m+1}$, respectively.

18. The method of claim 11, wherein the LCD panel further comprises a plurality of touch sensing signal lines $\{L_k\}$, k=1, 2, . . . , K, K being an integer greater than zero, each being arranged adjacent and parallel to a scanning line $G_n$ or a data line $D_m$.

19. The method of claim 18, wherein each pixel in the even number pixel rows of the pixel matrix or each pixel in the odd number pixel rows of the pixel matrix further comprises a photo sensor (PS) and a transistor having a gate electrically connected to one of two corresponding scanning lines defining the pixel, a source electrically connected the photo sensor and a drain electrically connected to a corresponding touch sensing signal line.

20. A liquid crystal display (LCD) panel, comprising:

(a) a common electrode;

(b) a plurality of scanning lines, $\{G_n\}$, n=1, 2, . . . , N, N being an integer greater than zero, spatially arranged along a row direction;

(c) a plurality of data lines, $\{D_m\}$, m=1, 2, . . . , M, M being an integer greater than zero, spatially arranged crossing the plurality of scanning lines $\{G_n\}$ along a column direction perpendicular to the row direction; and (d) a plurality of pixels, $\{P_{n,m}\}$, spatially arranged in the form of a matrix, each pixel $P_{n,m}$ defined between two neighboring scanning lines $G_n$ and $G_{n+1}$ and two neighboring data lines $D_m$ and $D_{m+1}$, and comprising at least a first sub-pixel, $P_{n,m}(1)$, and a second sub-pixel, $P_{n,m}(2)$, wherein each of the first sub-pixel and the second sub-pixel comprises a sub-pixel electrode, a liquid crystal (LC) capacitor electrically coupled between the sub-pixel electrode and the common electrode in parallel, and a transistor having a gate, a source and a drain electrically coupled to the sub-pixel electrode, wherein the gate and the source of the transistor of the first sub-pixel $P_{n,m}(1)$ of the pixel $P_{n,m}$ are electrically coupled to the scanning line $G_{n+1}$, and the data line $D_m$, respectively, and wherein the gate and the source of the transistor of the second sub-pixel $P_{n,m}(2)$ of the pixel $P_{n,m}$ are electrically coupled to the scanning line $G_n$ and the sub-pixel electrode of the first sub-pixel $P_{n,m}(1)$, respectively; and wherein the gate and the source of the transistor of the first sub-pixel $P_{n+1,m}(1)$ of the pixel $P_{n-1,m}$ are electrically coupled to the scanning line $G_{n+1}$ and the sub-pixel electrode of the second sub-pixel $P_{n+1,m}(2)$, respectively, and wherein the gate and the source of the transistor of the second sub-pixel $P_{n+1,m}(2)$ of the pixel $P_{n-1,m}$ are electrically coupled to the scanning line $G_{n+2}$ and the data line $D_{m+1}$, respectively.

21. The LCD panel of claim 20, wherein each of the first sub-pixel $P_{n,m}(1)$ and the second sub-pixel $P_{n,m}(2)$ of the pixel $P_{n,m}$ further comprises a storage capacitor electrically coupled between the sub-pixel electrode and the common electrode in parallel.

22. The LCD panel of claim 20, further comprising:

(a) a gate driver for generating a plurality of scanning signals respectively applied to the plurality of scanning lines $\{G_n\}$, wherein the plurality of scanning signals is configured to turn on the transistors connected to the plurality of scanning lines $\{G_n\}$ in a predefined sequence; and (b) a data driver for generating a plurality of data signals respectively applied to the plurality of data lines $\{D_m\}$, wherein the plurality of data signals is configured such that any two neighboring data signals have inverted polarities.

23. The LCD panel of claim 22, wherein each of the plurality of scanning signals is configured to have a waveform, wherein the waveform has a first voltage potential $V_1$ in a first duration, $T_1$, a second voltage potential $V_2$ in a second duration, $T_2$, a third voltage potential $V_3$ in a third duration, $T_3$, a fourth voltage potential $V_4$ in a fourth duration, $T_4$, and a fifth voltage potential $V_5$ in a fifth duration, $T_5$, wherein the (j+1)-th duration $T_{j-1}$ is immediately after the j-th duration $T_j$, j=1, 2, 3 and 4, and wherein $V_1=V_3=V_5>V_2=V_4$, $T_2=(T_1+2t)$, $T_3=(T_1-t)$, $T_4=2t$, $T_5=T_1$, and $T_1>>t$.

24. The LCD panel of claim 23, wherein the waveform of each of the scanning signals is sequentially shifted from one another by a duration of $T_1+T_2$.

25. The LCD panel of claim 22, wherein each of the plurality of scanning signals is configured to have a waveform, wherein the waveform of each of the plurality of scanning signals has a first voltage potential $V_1(t)$ in a first duration, $T_1$, a second voltage potential $V_2(t)$ in a second duration, $T_2$, and a third voltage potential $V_3(t)$ in a third duration, $T_3$, wherein the second duration $T_2$ is immediately after the first duration $T_1$ and the third duration $T_3$ is immediately after the second duration $T_2$, and wherein $V_1(t)$ and $V_3(t)$ vary with time and $V_2(t)=V_2$ is a constant and independent of time.

26. The LCD panel of claim 25, wherein the first duration $T_1$ includes a first time period, $T_0$, and a second time period, $T=(T_1-T_0)$, immediately after the first time period $T_0$, wherein in the first time period $T_0$, $V_1(t)=V_1$, a constant voltage potential, and $V_1(t)$ continuously decreases from $V_1$ to $V_0$ as time goes in the second time period T, and wherein the third duration $T_3$ includes a first time period, $T_0$, a second time period, T, immediately after the first time period $T_0$, and a third time period $(T_3-T_1-T_0)$, immediately after the second time period T, wherein $V_3(t)=V_3$, a constant voltage potential, in the first time period $T_0$, $V_3(t)$ continuously decreases from $V_3$ to $V_0$ as time goes in the second time period T, and $V_3(t)=V_3$ in the third time period, and wherein $V_1=V_3>V_2$, $V_1>V_0\geqq V_2$, $T_1=T_2$, and $T_3=2T_1$.

27. The LCD panel of claim 26, wherein the waveform of each of the scanning signals is sequentially shifted from one another by a duration of $T_1+T_2$.

28. The LCD panel of claim 22, wherein, in operation, the plurality of pixels $\{P_{n,m}\}$ has a pixel polarity that is in a dot inversion.

29. The LCD panel of claim 20, wherein each of the transistors is a field-effect thin film transistor (TFT).

30. The LCD panel of claim 20, further comprising a plurality of touch sensing signal lines $\{L_k\}$, k=1, 2, . . . , K, K being an integer greater than zero, each being arranged adjacent and parallel to a scanning line $G_n$ or a data line $D_m$.

31. The LCD panel of claim 30, wherein each pixel in the even number pixel rows of the pixel matrix or each pixel in the odd number pixel rows of the pixel matrix further comprises a photo sensor (PS) and a transistor having a gate electrically connected to one of two corresponding scanning lines defining the pixel, a source electrically connected the photo sensor and a drain electrically connected to a corresponding touch sensing signal line.

32. A liquid crystal display (LCD) panel, comprising:

(a) a plurality of pixels, $\{P_{n,m}\}$, spatially arranged in the form of a matrix, n=1, 2, . . . , N, and m=1, 2, . . . , M, and N, M being an integer greater than zero, each pixel $P_{n,m}$ comprising at least a first sub-pixel, $P_{n,m}(1)$ and a second sub-pixel, $P_{n,m}(2)$, wherein each of the first sub-pixel $P_{n,m}(1)$ and the second sub-pixel $P_{n,m}(2)$ comprises a sub-pixel electrode and a switching element electrically coupled to the sub-pixel electrode;

(b) a plurality of scanning lines, $\{G_n\}$, spatially arranged along a row direction, wherein each pair of two neighboring scanning lines $G_n$ and $G_{n+1}$ defines a pixel row $P_{n,\{m\}}$ of the pixel matrix $\{P_{n,m}\}$ therebetween and is electrically coupled to the switching elements of the first sub-pixel and the second sub-pixel of each pixel in the pixel row $P_{n,\{n\}}$, respectively; and (c) a plurality of data lines, $\{D_m\}$, spatially arranged crossing the plurality of scanning lines $\{G_n\}$ along a column direction perpendicular to the row direction, wherein each pair of two neighboring data lines $D_m$ and $D_{m+1}$ defines a pixel column, $P_{\{n\},m}$, of the pixel matrix $\{P_{n,m}\}$ therebetween, and wherein each data line $D_m$ is electrically coupled to the switching element of the first sub-pixel or the second sub-pixel of each odd pixel of one of two neighboring pixel columns $P_{\{n\},m-1}$ and $P_{\{n\},m}$ associated with the data line $D_m$ and to the switching element of the second sub-pixel or the first sub-pixel of each even pixel of the other of the two neighboring pixel columns $P_{\{n\},m-1}$ and $P_{\{n\},m}$.

33. The LCD panel of claim 32, further comprising at least one common electrode.

34. The LCD panel of claim 33, wherein each of the first sub-pixel $P_{n,m}(\mathbf{1})$ and the second sub-pixel $P_{n,m}(\mathbf{2})$ of the pixel $P_{n,m}$ of the pixel matrix $\{P_{n,m}\}$ further comprises an LC capacitor electrically coupled between the sub-pixel electrode and the common electrode in parallel.

35. The LCD panel of claim 34, wherein each of the first sub-pixel $P_{n,m}(\mathbf{1})$ and the second sub-pixel $P_{n,m}(\mathbf{2})$ of the pixel $P_{n,m}$ of the pixel matrix $\{P_{n,m}\}$ further comprises a storage capacitor electrically coupled between the sub-pixel electrode and the common electrode in parallel.

36. The LCD panel of claim 32, wherein each of the switching elements of the first sub-pixel $P_{n,m}(\mathbf{1})$ and the second sub-pixel $P_{n,m}(\mathbf{1})$ of the pixel $P_{n,m}$ of the pixel matrix $\{P_{n,m}\}$ is a field-effect thin film transistor having a gate, a source and a drain.

37. The LCD panel of claim 36, wherein the drain of the transistor of each of the first sub-pixel $P_{n,m}(\mathbf{1})$ and the second sub-pixel $P_{n,m}(\mathbf{2})$ of the pixel $P_{n,m}$ of the pixel matrix $\{P_{n,m}\}$ is electrically coupled to the sub-pixel electrode of the corresponding sub-pixel;

wherein the gate and the source of the transistor of the first sub-pixel $P_{n,m}(\mathbf{1})$ of the pixel $P_{n,m}$ of the pixel matrix $P\{_{n,m}\}$ are electrically coupled to the scanning line $G_{n+1}$ and the data line $D_m$, respectively;

wherein the gate and the source of the transistor of the second sub-pixel $P_{n,m}(\mathbf{2})$ of the pixel $P_{n,m}$ of the pixel matrix $\{P_{n,m}\}$ are electrically coupled to the scanning line $G_n$ and the sub-pixel electrode of the first sub-pixel $P_{n,m}(\mathbf{1})$, respectively;

wherein the gate and the source of the transistor of the first sub-pixel $P_{n+1,m}(\mathbf{1})$ of the pixel $P_{n-1,m}$ of the pixel matrix $\{P_{n,m}\}$ are electrically coupled to the scanning line $G_{n+1}$ and the sub-pixel electrode of the second sub-pixel $P_{n-1,m}(\mathbf{2})$, respectively; and wherein the gate and the source of the transistor of the second sub-pixel $P_{n+1,m}(\mathbf{2})$ of the pixel $P_{n+1,m}$ of the pixel matrix $\{P_{n,m}\}$ are electrically coupled to the scanning line $G_{n+2}$ and the data line $D_{m+1}$, respectively.

38. The LCD panel of claim 32, further comprising:

(a) a gate driver for generating a plurality of scanning signals respectively applied to the plurality of scanning lines $\{G_n\}$, wherein the plurality of scanning signals is configured to turn on the switching elements connected to the plurality of scanning lines $\{G_n\}$ in a predefined sequence; and (b) a data driver for generating a plurality of data signals respectively applied to the plurality of data lines $\{D_m\}$, wherein the plurality of data signals is configured such that any two neighboring data signals have inverted polarities.

39. The LCD panel of claim 38, wherein, in operation, the plurality of pixels $\{P_{n,m}\}$ has a pixel polarity that is in a dot inversion.

40. The LCD panel of claim 32, further comprising a plurality of touch sensing signal lines $\{L_k\}$, k=1, 2, . . . , K, K being an integer greater than zero, each being arranged adjacent and parallel to a scanning line $G_n$ or a data line $D_m$.

41. The LCD panel of claim 40, wherein each pixel in the even number pixel rows of the pixel matrix or each pixel in the odd number pixel rows of the pixel matrix further comprises a photo sensor (PS) and a transistor having a gate electrically connected to one of two corresponding scanning lines defining the pixel, a source electrically connected the photo sensor and a drain electrically connected to a corresponding touch sensing signal line.

* * * * *

UNITED STATES PATENT AND TRADEMARK OFFICE

CERTIFICATE OF CORRECTION

PATENT NO. : 7,567,228 B1
APPLICATION NO. : 12/204443
DATED : July 28, 2009
INVENTOR(S) : Yi-Chien Wen et al.

It is certified that error appears in the above-identified patent and that said Letters Patent is hereby corrected as shown below:

Column 2, line 15, “G_[n]” should read: --G_[n+1]--

Column 3, line 55, “D_[mm+1]” should read: --D_[m+1]--

Column 4, line 32, “P{n},m” should read: --P_[{n},m]--

Column 5, line 8, “G_[n+]” should read: --G_[n+1]--

Column 5, line 41, “G_[n-1]” should read: --G_[n+1]--

Column 5, line 49, “P_[{n}]m” should read: --P_[{n},m]--

Column 10, line 42, “P_[1],o” should read: --P_[1,0]--

Column 10, line 50, “P_[1]” should read: --P_[1,1]--

Column 16, line 56, “P{n},m-1 and P{n},m” should read: --P_[{n},m-1] and P_[{n},m]--

Column 18, line 34, “P_[n+1,m](1)” should read: --P_[n, m](1)--

Column 18, line 36, “P_[n-1,m]m(1) of the pixel P_[n-1,m]” should read: --P_[n+1,m](1)of the pixel P_[n+1,m]--

Column 18, line 42, “G_[n-2]” should read: --G_[n+2]--

Column 18, line 43, “D_[m-1]” should read: --D_[m+1]--

Column 18, line 59, “T_[j-1]” should read: --T_[j+1]--

Signed and Sealed this
First Day of February, 2011

David J. Kappos

David J. Kappos
*Director of the United States Patent and Trademark Office*

Column 20, line 2, “D_[m-1]” should read: --D_[m+1]--

Column 20, line 37, “P_[n,m](1)” should read: --P_[n,m](2)--

Column 20, line 55, “P_[n-1,m]” should read: --P_[n+1,m]--

Column 20, line 58, “P_[n-1,m](2)” should read: --P_[n+1,m](2)--

Column 21, line 38, “P_[n-1,m]” should read: --P_[n+1,m]--

Column 21, line 43, “P_[n-1,m]” should read: --P_[n+1,m]--

Column 22, line 67, “P_[n,{n}]” should read: --P_[n,{m}]--

Column 23, line 38, “P{_[n,m]}” should read: --{P_[n,m]}--

Column 24, line 5, “P_[n-1,m]” should read: --P_[n+1,m]--

Column 24, line 8, “P_[n-1,m](2)” should read: --P_[n+1,m](2)--